US010544621B2

(12) United States Patent
Mocanu et al.

(10) Patent No.: US 10,544,621 B2
(45) Date of Patent: Jan. 28, 2020

(54) ROLLER SHADE SYSTEM

(71) Applicant: Sun Glow Window Covering Products of Canada Ltd., Toronto (CA)

(72) Inventors: Catalin Aurel Mocanu, Mississauga (CA); Philip Cappello, Bolton (CA)

(73) Assignee: Sun Glow Window Covering Products of Canada Ltd., Toronto (CA)

( * ) Notice: Subject to any disclaimer, the term of this patent is extended or adjusted under 35 U.S.C. 154(b) by 182 days.

(21) Appl. No.: 15/252,016

(22) Filed: Aug. 30, 2016

(65) Prior Publication Data

US 2017/0058600 A1 Mar. 2, 2017

Related U.S. Application Data

(60) Provisional application No. 62/212,500, filed on Aug. 31, 2015.

(51) Int. Cl.

| | |
|---|---|
| ***E06B 9/42*** | (2006.01) |
| ***E06B 9/44*** | (2006.01) |
| ***E06B 9/78*** | (2006.01) |

(52) U.S. Cl.

CPC ..... *E06B 9/42* (2013.01); *E06B 9/44* (2013.01); *E06B 9/78* (2013.01)

(58) Field of Classification Search

CPC ..... E06B 9/17023; E06B 9/17007; E06B 9/17015; E06B 9/17; E06B 9/42; E06B 9/50; E06B 9/78; E06B 9/40; E06B 2009/785; A47H 1/13

USPC ..... 160/323.1–326, 242–261, 903, DIG. 11; 248/266–272

See application file for complete search history.

(56) References Cited

U.S. PATENT DOCUMENTS

| | | | | | |
|---|---|---|---|---|---|
| 1,025,312 | A * | 5/1912 | Rydquist | A47K 10/36 | 242/564.1 |
| 1,499,340 | A * | 7/1924 | Bundy, Jr. | E06B 9/50 | 248/269 |
| 2,013,500 | A * | 9/1935 | O'Connor | E06B 9/50 | 248/269 |
| 3,310,099 | A * | 3/1967 | Hunter | E06B 9/32 | 160/171 |

(Continued)

FOREIGN PATENT DOCUMENTS

| | | | | |
|---|---|---|---|---|
| DE | 19522973 | A1 * | 1/1997 | E06B 9/17023 |
| DE | 202015003705 | U1 * | 6/2015 | E06B 9/17023 |
| DE | 102016123321 | A1 * | 6/2018 | E06B 9/17015 |
| EP | 1705335 | A2 * | 9/2006 | E06B 9/17023 |
| EP | 2177458 | A2 * | 4/2010 | B65D 7/065 |
| FR | 2885942 | A1 * | 11/2006 | E06B 9/17023 |

(Continued)

OTHER PUBLICATIONS

Spring Assist; Jun. 9, 2015; RollEase Product Catalogue (2 pages).

(Continued)

*Primary Examiner* — Johnnie A. Shablack

(74) *Attorney, Agent, or Firm* — Brett J. Slaney; Blake, Cassels & Graydon LLP

(57) ABSTRACT

A roller shade system comprising a covering material windingly coupled to a roller tube such that rotation of the roller tube causes the covering material to be raised or lowered. A mechanism is coupled to the roller tube to rotate the roller tube and a level adjuster is attached to each end of the roller tube. The level adjuster includes a baseplate with a leveling bar pivotally coupled to the baseplate. A valance assembly to enclose the roller tube, mechanism, and level adjuster, while permitting the fabric through an opening is also provided.

17 Claims, 30 Drawing Sheets

(56) References Cited

U.S. PATENT DOCUMENTS 3,730,469 A * 5/1973 Shields ..... A47H 1/12 248/258
5,092,389 A * 3/1992 Tedeschi ..... E06B 9/78 160/321
5,205,334 A * 4/1993 Judkins ..... B23Q 3/15526 160/108
5,259,687 A 11/1993 John
5,647,421 A * 7/1997 Hoffmann ..... E06B 9/40 160/120
5,803,144 A 9/1998 Ives
6,161,607 A * 12/2000 de Kimpe ..... E06B 9/40 160/121.1
6,164,428 A * 12/2000 Berman ..... E06B 9/42 160/298
6,196,508 B1 * 3/2001 Nijs ..... A47H 1/13 248/267
6,532,109 B1 * 3/2003 Shopp ..... G03B 21/58 160/23.1
6,873,461 B1 * 3/2005 McPherson, Jr. ..... E06B 9/50 160/23.1
6,907,964 B2 * 6/2005 Savard ..... E05D 13/1261 160/191
6,935,401 B2 * 8/2005 Fraczek ..... E06B 9/50 160/321
6,941,996 B2 * 9/2005 Ward ..... E06B 9/264 160/108
7,134,473 B2 * 11/2006 Lukos ..... E06B 9/50 160/242
7,275,581 B2 * 10/2007 Coenraets ..... E06B 9/17 160/237
7,451,956 B2 * 11/2008 Bohlen ..... E06B 9/323 248/220.21
7,559,707 B2 * 7/2009 Shopp ..... G03B 21/58 396/461
7,677,294 B2 * 3/2010 Bohlen ..... E06B 9/50 160/323.1
7,770,625 B2 * 8/2010 Lukos ..... E04F 10/0662 160/242
7,836,937 B2 * 11/2010 Anderson ..... E06B 9/34 160/170
7,854,419 B2 * 12/2010 Ng ..... E06B 9/50 160/323.1
7,900,680 B2 * 3/2011 Garmyn ..... E06B 9/42 160/23.1
8,016,016 B2 * 9/2011 Berman ..... E06B 9/50 160/242
8,122,932 B2 * 2/2012 Cannaverde ..... E06B 9/174 160/120
8,136,569 B2 * 3/2012 Bohlen ..... E06B 9/42 160/323.1
8,151,859 B2 * 4/2012 Koop ..... E06B 9/50 160/325
8,220,520 B2 * 7/2012 Lukos ..... E04F 10/0662 160/242
8,276,642 B2 * 10/2012 Berman ..... E06B 9/50 160/242
8,418,742 B2 * 4/2013 Anderson ..... E06B 9/34 160/308
8,480,048 B2 * 7/2013 Krantz-Lilienthal ... F16B 2/245 160/23.1
8,505,865 B2 * 8/2013 Wills ..... E06B 9/42 160/323.1
8,579,004 B2 * 11/2013 Cannaverde ..... E06B 9/174 160/120
8,839,841 B2 * 9/2014 Koop ..... E06B 9/50 160/325
8,844,605 B2 9/2014 Ng
8,960,621 B2 * 2/2015 Wills ..... F16B 5/0614 160/19
8,967,227 B2 * 3/2015 Chou ..... A47H 1/14 160/23.1
8,967,568 B2 * 3/2015 Wills ..... E06B 9/50 160/323.1
9,016,347 B2 * 4/2015 Lin ..... E06B 9/324 160/321
9,060,636 B2 * 6/2015 Cannaverde ..... E06B 9/174
9,206,641 B2 * 12/2015 Feldstein ..... E06B 9/50
9,279,286 B2 * 3/2016 Higgins ..... E06B 9/174
9,347,261 B2 * 5/2016 Blair ..... E06B 9/42
9,476,255 B2 * 10/2016 Nurre ..... E06B 9/42
9,670,719 B2 * 6/2017 Marocco ..... E06B 9/44
9,719,297 B1 * 8/2017 Chen ..... E06B 9/34
9,890,588 B2 * 2/2018 Smith ..... E06B 9/50
9,945,177 B2 * 4/2018 Drew ..... E06B 9/44
10,214,960 B2 * 2/2019 Ng ..... E06B 9/50
2002/0189771 A1 * 12/2002 Colson ..... E06B 9/32 160/323.1
2005/0183835 A1 8/2005 Nien
2007/0120031 A1 * 5/2007 Rasmussen ..... E06B 9/50 248/266
2008/0135191 A1 * 6/2008 Zakowski ..... E06B 9/50 160/181
2008/0202709 A1 * 8/2008 Anderson ..... E06B 9/34 160/321
2008/0257505 A1 * 10/2008 Braybrook ..... E06B 9/42 160/321
2009/0152422 A1 * 6/2009 Ng ..... E06B 9/50 248/265
2012/0031572 A1 * 2/2012 Ng ..... E06B 9/50 160/321
2012/0160975 A1 * 6/2012 Cannaverde ..... E06B 9/174 248/208
2013/0068398 A1 * 3/2013 Wills ..... E06B 9/42 160/26
2013/0068904 A1 * 3/2013 Wills ..... E06B 9/50 248/207
2013/0240661 A1 * 9/2013 Wills ..... E06B 9/42 242/615
2014/0166218 A1 * 6/2014 Ng ..... E06B 9/42 160/120
2015/0007949 A1 * 1/2015 Daniels ..... E06B 9/50 160/323.1
2015/0297014 A1 * 10/2015 Cannaverde ..... E06B 9/174 248/558
2015/0345216 A1 * 12/2015 Feldstein ..... E06B 9/50 160/310
2015/0368970 A1 * 12/2015 Chambers ..... E06B 9/80 160/323.1
2016/0340972 A1 * 11/2016 Chou ..... E06B 9/24
2017/0114593 A1 * 4/2017 Hebeisen ..... E06B 9/17007
2017/0204659 A1 * 7/2017 Marcinik ..... E06B 9/174
2018/0023340 A1 * 1/2018 Goldberg ..... E06B 9/56
2018/0112461 A1 * 4/2018 Holt ..... E06B 9/42
2018/0142518 A1 * 5/2018 Ng ..... E06B 9/50
2018/0171708 A1 * 6/2018 Alonso Fabregat .... E06B 9/174
2018/0202157 A1 * 7/2018 Neal ..... E04B 9/30
2018/0252032 A1 * 9/2018 Garcia Garcia ..... E06B 9/42
2019/0024452 A1 * 1/2019 Derk, Jr. ..... E06B 9/72
2019/0029455 A1 * 1/2019 Ng ..... A47H 1/13
2019/0085626 A1 * 3/2019 Ng ..... E06B 9/44

FOREIGN PATENT DOCUMENTS

FR 2976960 B3 * 8/2013 ..... E06B 9/17023
FR 3023575 A1 * 1/2016 ..... E06B 9/17007
WO WO-2009101198 A1 * 8/2009 ..... E06B 9/17023

OTHER PUBLICATIONS

Spring Assist for RS Clutch; publicly available at least as early as Jun. 12, 2015; ZMC Window Covering Supplies technical specification document (5 pages).

* cited by examiner

ROLLER SHADE SYSTEM

CROSS-REFERENCE TO RELATED APPLICATION(S)

This application claims priority to U.S. Provisional Patent Application No. 62/212,500 filed on Aug. 31, 2015, the contents of which are incorporated herein by reference.

TECHNICAL FIELD

The following relates to coverings for windows, doors, or other structures; and more specifically to roller shade coverings.

DESCRIPTION OF THE PRIOR ART

Roller shades (also referred to as roller blinds) are commonly used as coverings for windows, doors, or other structures. Roller shades are typically used for aesthetic purposes in decorating, to provide noise dampening, and to control or inhibit light entering a room.

Roller shades typically include a covering material such as a piece of fabric dimensioned to cover the window, a lifting/lowering mechanism for lifting and lowering the fabric, a valance or fascia covering to enclose the lifting/lowering mechanism, and mounting brackets to mount the roller shade on a surface of the window frame or surrounding area. The lifting/lowering mechanism typically includes an elongated tube having a circular cross section coupled to the fabric such that the fabric can roll onto the tube, and a clutch system coupled to a chain. The mechanism can be either manually operated by pulling the chain, have a chainless operation using a pre-tensioned spring, or can be automated using a motor.

When concerning light control through the windows, among the goals of the roller shade is to minimize the leakage of light while at that same time presenting an aesthetic and appealing design. As such, the fabric can be made from a variety of materials having low permeability to light while being dimensioned to cover the window to minimize leaking of light around edges of the fabric. The valance covering is utilized to provide an enclosure for the components of the lifting/lowering mechanism and is typically meant to be discreet and consistent with the design of the roller shade.

Two types of roller shade configurations exist, each utilizing different methods for rolling the fabric. The first is referred to as a standard or regular roll, and the second is a reverse roll. In the regular roll configuration, the fabric hangs behind the tube, closer to the window; whereas in the reverse roll configuration, the fabric hangs in front of the tube, closer to the interior of the room. Valances are typically created to accommodate the type of roller shade with which it is used, thus requiring different models to be provided for the same general design.

As noted above, a roller shade is normally affixed to a surface such as the inside surface of a window frame by fastening mounting brackets onto the window frame to hold the shade in place. These brackets are either situated at each end of the lifting/lowering mechanism or above the valance covering. However, it is often found that the brackets are installed such that the shade is not level. This in turn can lead to the fabric inadequately covering the window causing light to leak around edges and may provide an unaesthetic appearance to the roller shade.

It is therefore an object of the following to obviate or mitigate the above limitations.

SUMMARY

A roller shade system having adjustability and configurability is provided. The roller shade system includes a modular valance assembly to enable both regular and reverse roll configurations using the same system. The roller shade system described below also includes a low profile leveling mechanism that enables the roller shade to be leveled while minimizing the effects on the aesthetics of the roller shade.

In one aspect, there is provided a leveling mechanism for a roller shade, the leveling mechanism comprising a baseplate, the baseplate having a flange, the flange having a passage; a bar having a pivot coupled to the baseplate at one end, the pivot being spaced from the flange of the baseplate, the bar having a protrusion at an end aligned with the flange of the baseplate, and the bar having a support for the roller shade located between the pivot and the protrusion; and an adjustment member supported by the passage on the flange of the baseplate, the adjustment member being moveable with respect to the flange to adjust the position of the support by contacting the protrusion.

In another aspect, there is provided a modular valance assembly for a roller shade, the modular valance assembly for a roller shade having a top valance member having a projecting cantilevered rib along one edge; a bottom valance member having a mounting flange along at least one longitudinal edge, the bottom valance member having a width less than the top valance member; a front valance member having a first track along one longitudinal edge and a second track along an opposing edge, wherein the first track is spaced to fit the projecting cantilevered rib of the top valance member and the second track is spaced to fit the mounting flange of the bottom valance member; and a rear valance member having a track along one longitudinal edge, the edge aligned with the opposing edge having the second track of the front valance member, wherein the track on the rear valance is spaced to fit the projecting rib of the top valance member, wherein the top and bottom valance members are positioned substantially perpendicular to the front and rear valance members when attached, and wherein the bottom valance member is attachable to only one of the front valance member or the rear valance member at a time.

In yet another aspect, there is provide a chain guide for a roller shade system, the chain guide comprising a first member having at least one attachment point configured to mate with a valance assembly for the roller shade system at one end of the roll, the chain guide further comprising a pair of passages to permit a chain used to operate the roller shade system to pass therethrough.

In yet another aspect, there is provided a roller shade system comprising: an elongated covering material secured to a tube to permit the material to be rolled about the tube; a first clutch assembly secured to one end of the tube; and a second clutch assembly secure to the other end of the tube; wherein the first and second clutch assemblies have at least one low friction surface adjacent respective edges of the material to maintain alignment of the material on the tube and inhibit fraying thereof; wherein both the first clutch assembly and the second clutch assembly are capable of supporting a chain to operate the system.

In yet another aspect, there is provided a roller shade system comprising an elongated covering material having low permeability to light; a lifting/lowering mechanism having a hollow circular tube windingly coupled to the covering material, a clutch coupled to at least one end of the tube, an idle end coupled to the opposing end of the tube, and a chain coupled to each clutch wherein pulling the chain in one direction causes the tube to rotate in one direction and causes the covering material to roll onto the tube, while pulling the chain in the opposing direction causes the tube to rotate in the opposing direction causing the covering material to unroll from the tube; a leveling mechanism comprising a baseplate, the baseplate having a flange, the flange having a passage; a bar having a pivot coupled to the baseplate at one end, the pivot being spaced from the flange of the baseplate, the bar having a protrusion at an end aligned with the flange of the baseplate, and the bar having a support for the roller shade located between the pivot and the protrusion; and an adjustment member supported by the passage on the flange of the baseplate, the adjustment member being moveable with respect to the flange to adjust the position of the support by contacting the protrusion; a modular valance assembly for the roller shade having a top valance member having a projecting cantilevered rib along one edge; a bottom valance member having a mounting flange along at least one longitudinal edge, the bottom valance member having a width less than the top valance member; a front valance member having a first track along one longitudinal edge and a second track along an opposing edge, wherein the first track is spaced to fit the projecting cantilevered rib of the top valance member and the second track is spaced to fit the mounting flange of the bottom valance member; and a rear valance member having a track along one longitudinal edge, the edge aligned with the opposing edge having the second track of the front valance member, wherein the track on the rear valance is spaced to fit the projecting rib of the top valance member, wherein the top and bottom valance members are positioned substantially perpendicular to the front and rear valance members when attached, and wherein the bottom valence valance member is attachable to only one of the front valence valance member or the rear valance member at a time.

BRIEF DESCRIPTION OF DRAWINGS

Embodiments will now be described by way of example only with reference to the accompanying drawings in which:

FIG. 1(*b*) is an alternative embodiment of the roller shade system shown in FIG. 1

FIG. 10(*b*) is a cross sectional view across A-A of FIG. 1 according to another regular roll valance configuration for the roller shade system;

FIG. 10(*c*) is a cross sectional view across A-A of FIG. 1 according to yet another regular roll valance configuration for the roller shade system;

FIG. 11(*b*) is a cross-sectional view showing an installed rubber spline;

FIG. 15(*b*) is a cross sectional view across A-A of FIG. 1 according to another reverse roll valance configuration for the roller shade system;

FIG. 15(*c*) is a cross sectional view across A-A of FIG. 1 according to yet another reverse roll valance configuration for the roller shade system;

DETAILED DESCRIPTION OF THE INVENTION

It has been recognized that roller shades can have varying designs, and it is often difficult to alter the current valance assembly to accommodate different designs of valance systems. The following provides a modular valance assembly for a roller shade that enables both regular and reverse roll configurations using the same system.

It has also been recognized that roller shades, when installed, may not be level and could require adjusting. The following also provides a low profile leveling mechanism that enables the roller shade to be leveled while minimizing the effects on the aesthetics of the roller shade.

Figure 1A:
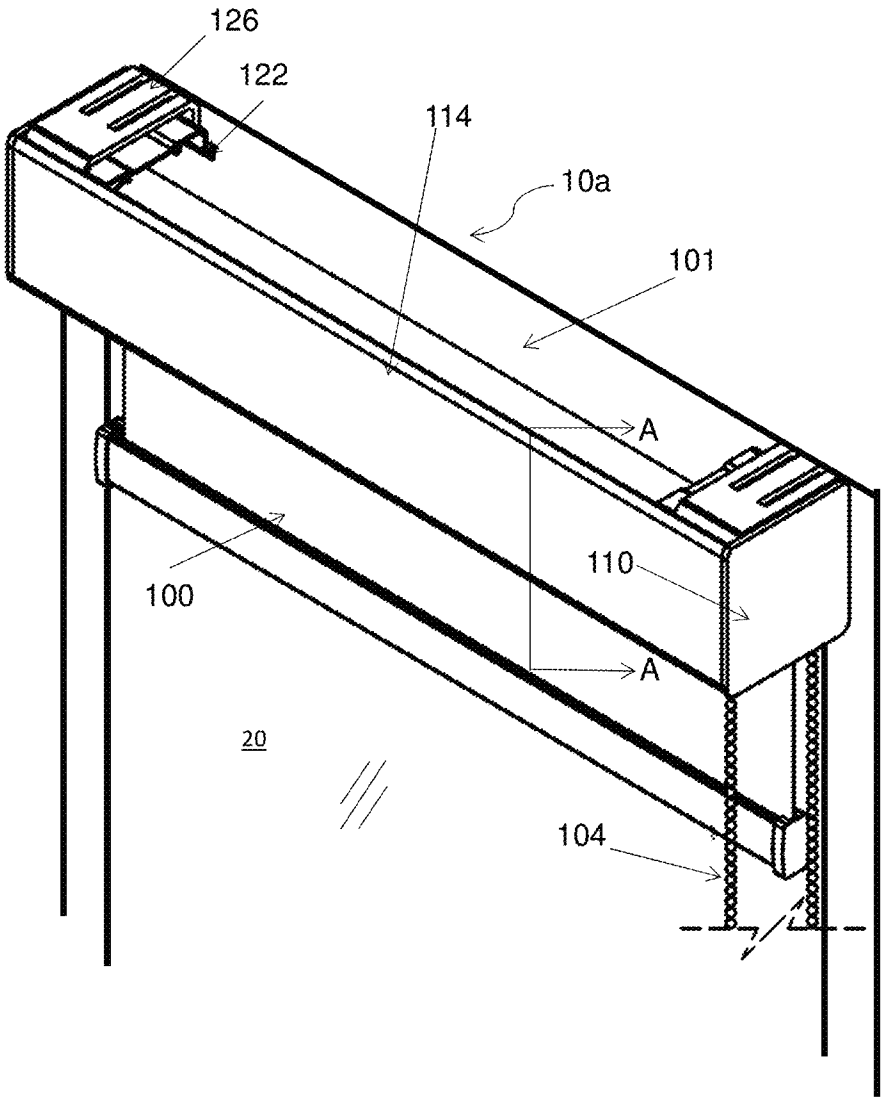
FIG. 1(*a*) is a perspective view of a roller shade system.
Figure 1B:
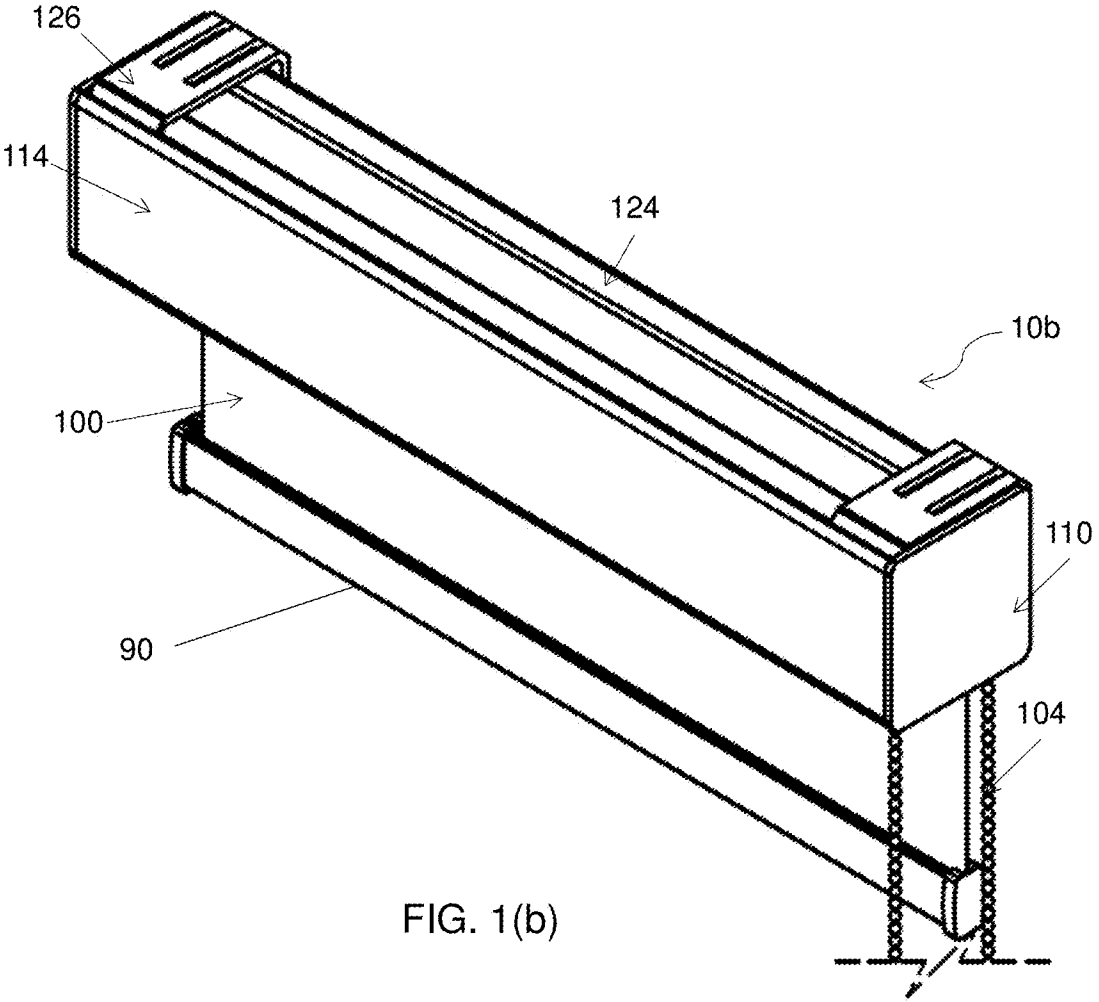

As shown in FIGS. 1(*a*) and 1(*b*), an adjustable roller shade system 10 is provided, which can be used to cover a window, door, or other structure or surface (not shown). The roller shade system 10*a* shown in FIG. 1(*a*) comprises a covering material such as fabric 100 coupled to a lifting/lowering mechanism 101, leveling mechanisms 108 coupled to the lifting/lowering mechanism 101 coupled to one or a pair of chains 104, a modular valance assembly 114 to provide an enclosure and act as housing to the lifting/lowering mechanism 101, mounting brackets 126, and end caps 110. The modular valance assembly 114 and end caps 110 collectively contain the lifting/lowering mechanism 101 and leveling mechanisms 108 and may also be referred to as a "cassette". The cassette is configured in various ways using modular and changeable components as described herein. The fabric 100 typically has a weighting bar 90 attached to a free end thereof, with the other end attached to the lifting/lowering mechanism 101 as described later. The fabric 100 is dimensioned to substantially correspond to the height and width of a window 20 which it covers (see, for example, FIG. 1(*b*)) and is typically composed of a material having a low permeability to light to limit or inhibit light entering a room, e.g. through the window 20.

As shown in FIG. 1(*b*), a roller shade system 10*b* utilizes a top fascia 124 to provide a fully enclosed cassette. Referring again to FIG. 1(*a*), when compared to FIG. 1(*b*), the system 10*a* includes a pair of assembly brackets 122 that have a profile that is similar to the top fascia 124 used in system 10*b*. In this way, the assembly brackets 122 and top fascia 124 can be made from the same extrusion and simply cut to a desired length accordingly. That is, the roller shade system 10*b* can be adapted from the system 10*a* by utilizing the top fascia 124 in place of assembly brackets 122 located at each mounting bracket 126.

Figure 2:
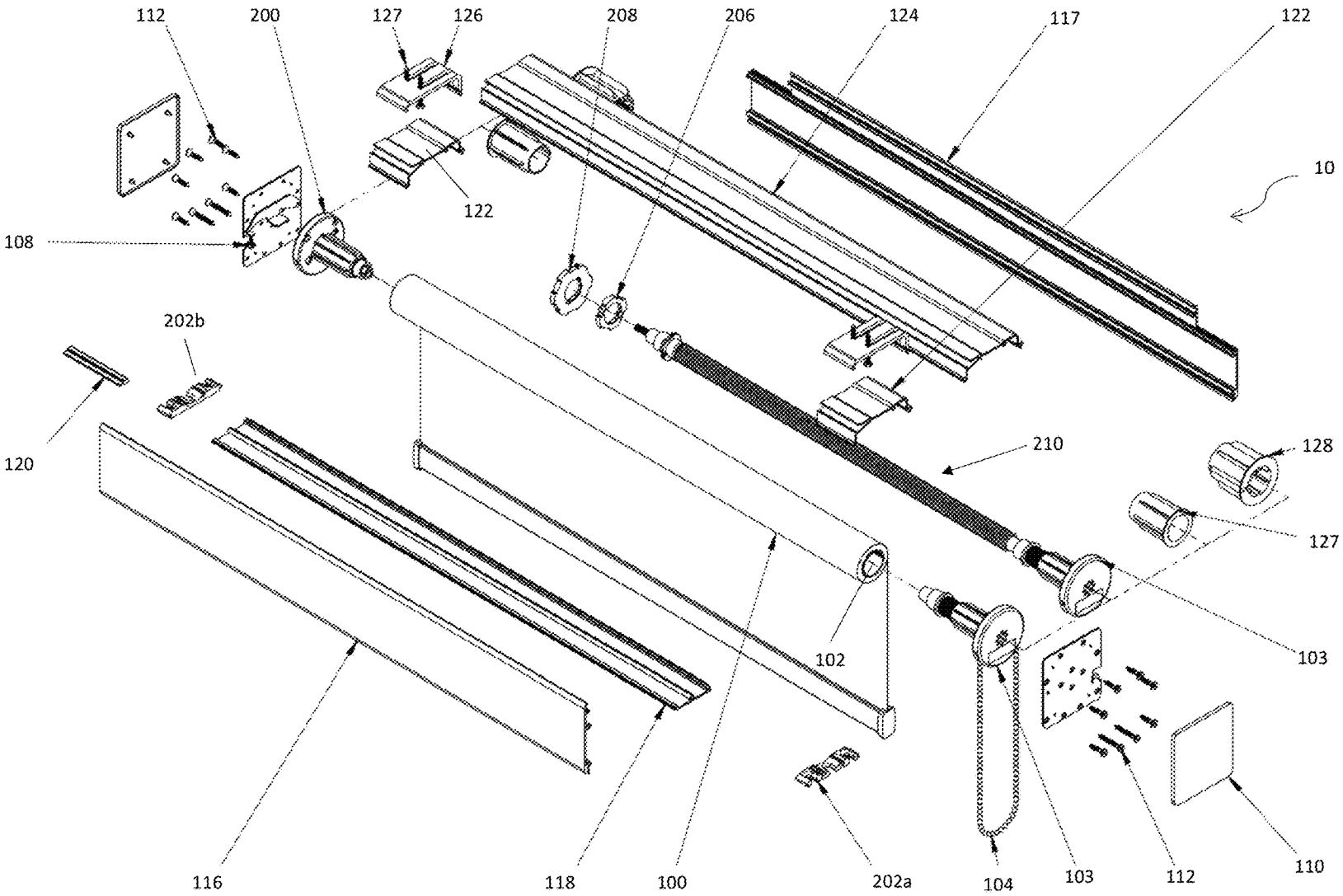
FIG. 2 is an exploded view of a roller shade system.
Figure 5:
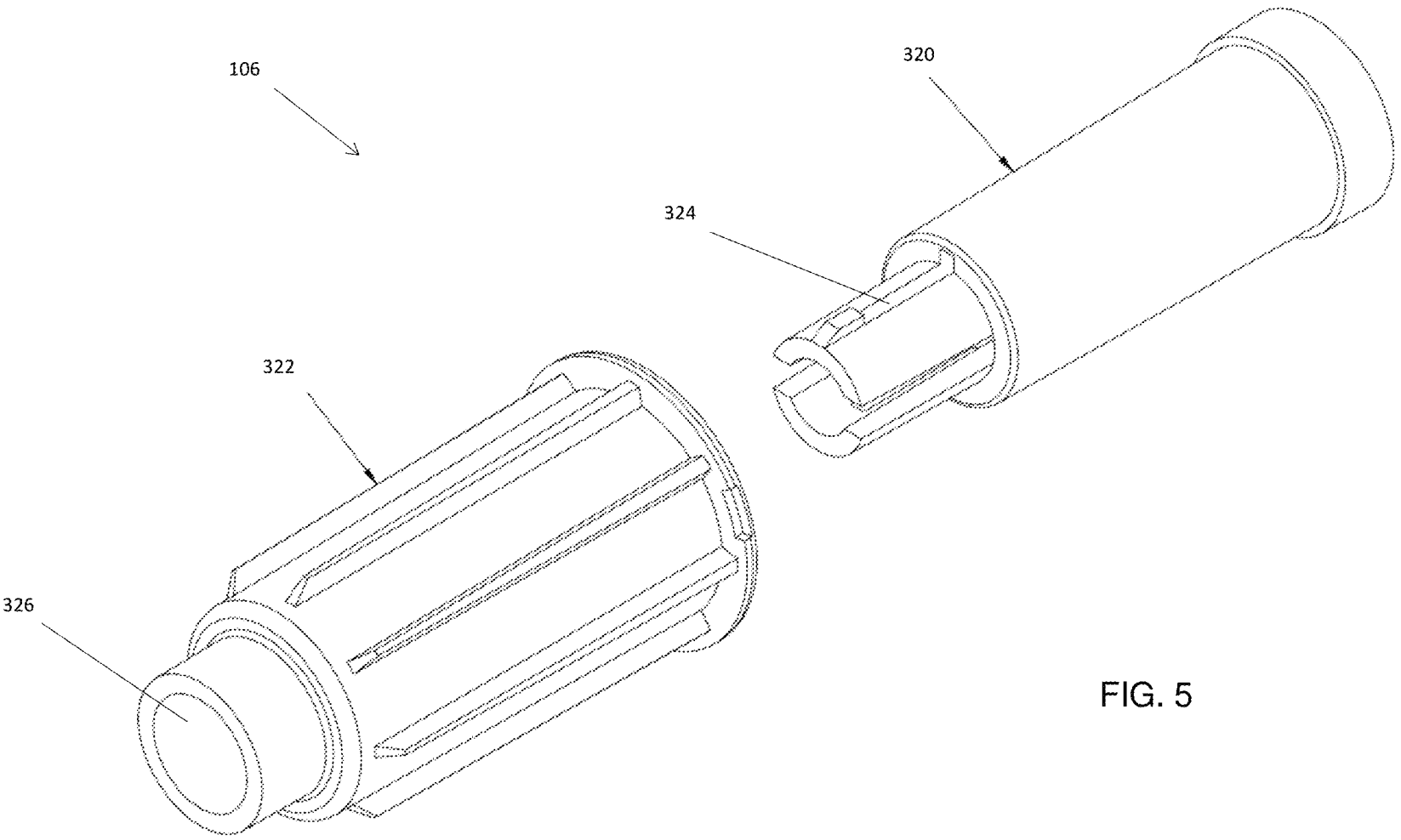
FIG. 5 is an exploded view of an idle end assembly.

An exploded view of the roller shade system 10 is shown in FIG. 2 illustrating the various configurable components described herein. As shown in FIG. 2, the lifting/lowering mechanism 101 comprises an elongated hollow tube 102 to which the fabric 100 is attached. A primary a clutch assembly 103 coupled to a chain 104 is inserted at one end of the hollow tube 102 and includes a braking mechanism. A secondary clutch 200 is inserted at the other end of the hollow tube 102. The secondary clutch 200 is used to both maintain alignment of the fabric 100 on the tube 102, and to enable the chain 104 to be repositioned at the other end of the assembly 101 or to add a second chain at that end. It can be appreciated that the secondary clutch assembly 200 can be replaced by an idle end 106 (see FIG. 5 described below). To accommodate different sizes of tubes 102, tube adapters 127, 128 can be secured over the clutch assemblies 103, 200. The tube 102 has a circular cross-section having a length slightly longer than the width of the fabric 100. The fabric 100 is coupled to the tube 102 such that rotation of the tube in one direction causes the fabric to roll onto the tube and rotation in the opposing direction causes the fabric 100 to unroll from the tube 102 to cover the underlying window 20. A leveling mechanism 108 is positioned adjacent each clutch assembly 103, 200 and the end caps 110 secured thereover. The modular valance assembly 114 components are also shown in FIG. 2 and will be referred to below in greater detail.

FIG. 2 illustrates a lift assist mechanism 210 that can be coupled to one or both of the clutch assemblies 103, 200 to counteract the weight of the fabric 100 during operation of the roller shade system 10. Such lift assist mechanisms 210 include the use of tensioned springs that are inserted within the tube 102 to cooperate with the clutch assembly 103, 200 in lifting and lowering heavier and/or longer fabrics. It can be appreciated that though the lifting/lowering mechanisms is shown in the exemplary embodiments to be manually operated, the mechanism can be automated through the use of a motor operable within the tube 102. Further detail concerning the lift assist mechanism 210 is provided below. The lift assist mechanism 210 in this example can be coupled to a adapter discs 206, 208, which can be sized to accommodate different sizes of tubes 102, similar to the tube adapters 127, 128. The adapter discs 206, 208 and lift assist mechanism 210 have an outermost profile that enables engagement with a series of grooves on the interior surface of the tube 102 in order to cause rotation of the lift assist mechanism 210 in tandem with rotation of the tube 102. In this way, the spring is tensioned and released as the fabric 100 is lowered and raised.

Chain guides 202*a*, 202*b* can also be used to maintain separation between the upwardly and downwardly running portions of the chain 104 and to maintain alignment of the chain 104 and the periphery of the clutch assembly 103. The chain guides 202*a*, 202*b* can be sized for a particular model and its associated dimensions and/or can include extenders (see also FIG. 13) to accommodate different cassette sizes. It can be appreciated that the chain guides 202*a*, 202*b* can also be used with the other implementations of the roller shade system 10*a*, 10*b* herein described. Having a chain guide 202 at each end of the cassette enables the chain 104 to be positioned at either end, or two chains 104 to be used. This allows flexibility during assembly on site to suit customer or builder preferences and/or changes to design specifications, etc. As noted above, providing the secondary clutch assembly 200 also facilitates this flexibility. FIG. 2 also illustrates that the roller shade system 10 can also be configured to use either the assembly brackets 122 or the top fascia 124 depending on the particular application, providing even further flexibility in the assembly.

Figure 3:
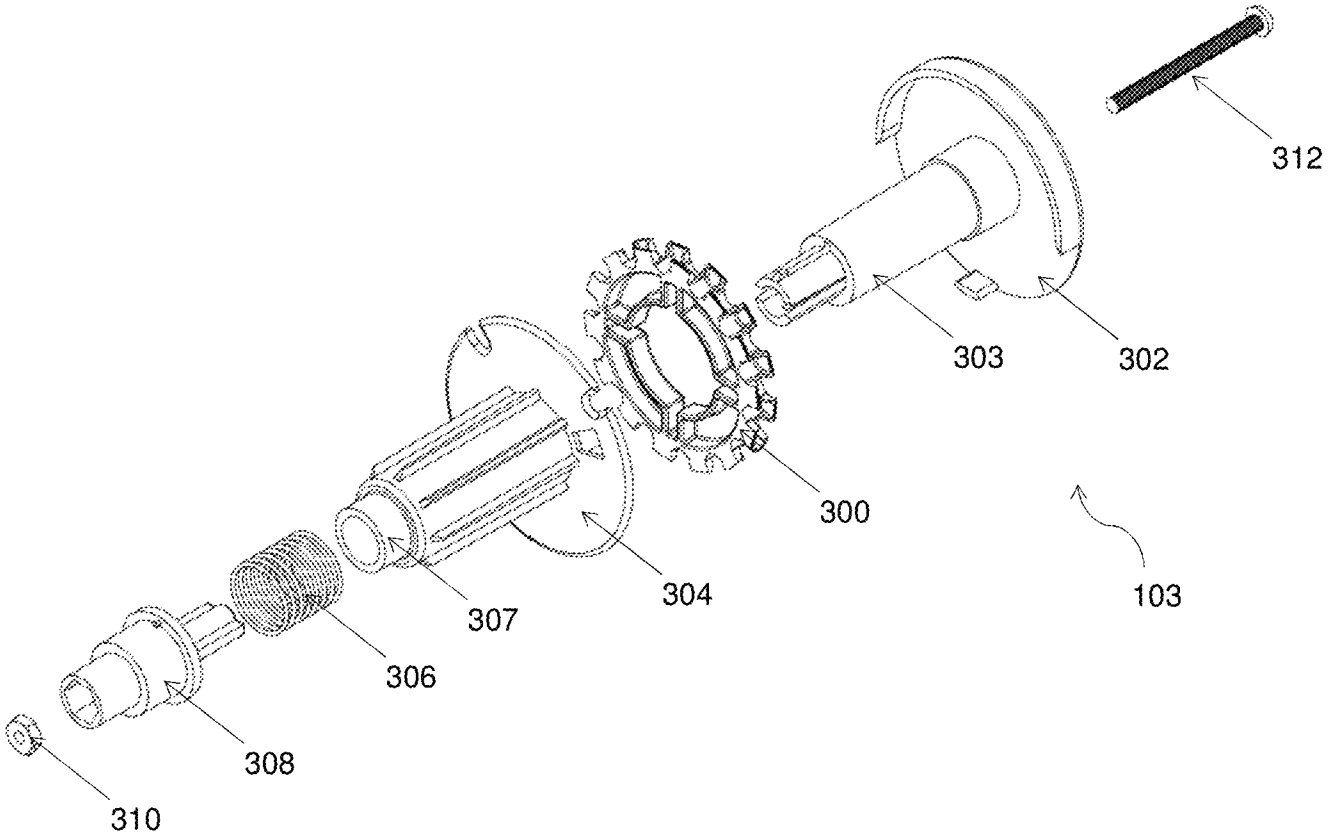
FIG. 3 is an exploded view of the brake clutch assembly of the roller shade system shown in FIG. 2.

As seen in FIG. 3(*a*), the clutch assembly 103 has a sprocket 300 having an outer sprocket cover 302 with an extruded stem 303 and an inner sprocket cover 304. The inner sprocket cover 302 supports a brake spring 306 on its rim 307 through a brake spring connector 308. The sprocket 300, inner sprocket cover 302, outer sprocket cover 304, brake spring 306, and brake spring connector 308 all have corresponding central apertures that are aligned when assembled together. The clutch 103 is assembled by mating the sprocket 300 onto the outer sprocket cover 302 and placing the inner sprocket cover 304 onto the sprocket 300. The brake spring 306 is then placed onto the rim 307 and is compressed against the brake spring connector 308. The clutch assembly 103 is assembled by inserting the fastening bolt 312 through the central aperture in the outer sprocket cover 302 and inserting the nut 310 into the brake spring connector 308, the nut 310 is then fastened onto the bolt 312. The inner sprocket cover 304 can be made of a low friction material such as plastic to inhibit fraying of the fabric 100 if contact is made therebetween. Moreover, the low friction material encourages the fabric 100 to stay aligned on the tube 102, particularly when the primary clutch assembly 103 and secondary clutch assembly 200 are both used.

The chain 104 is coupled to the clutch assembly 103 by mating the chain 104 into the teeth of the sprocket 300. The chain can be made of either plastic or metal and the term "chain" is used generally herein to refer to a string-like member that acts as a pulley to operate the lifting/lowering mechanism 101. The chain 104 can be adapted to include limit setting devices (often referred to as "stop beads") that stop the chain from being fed into the cassette by being attached directly to the chain 104.

Figure 4:
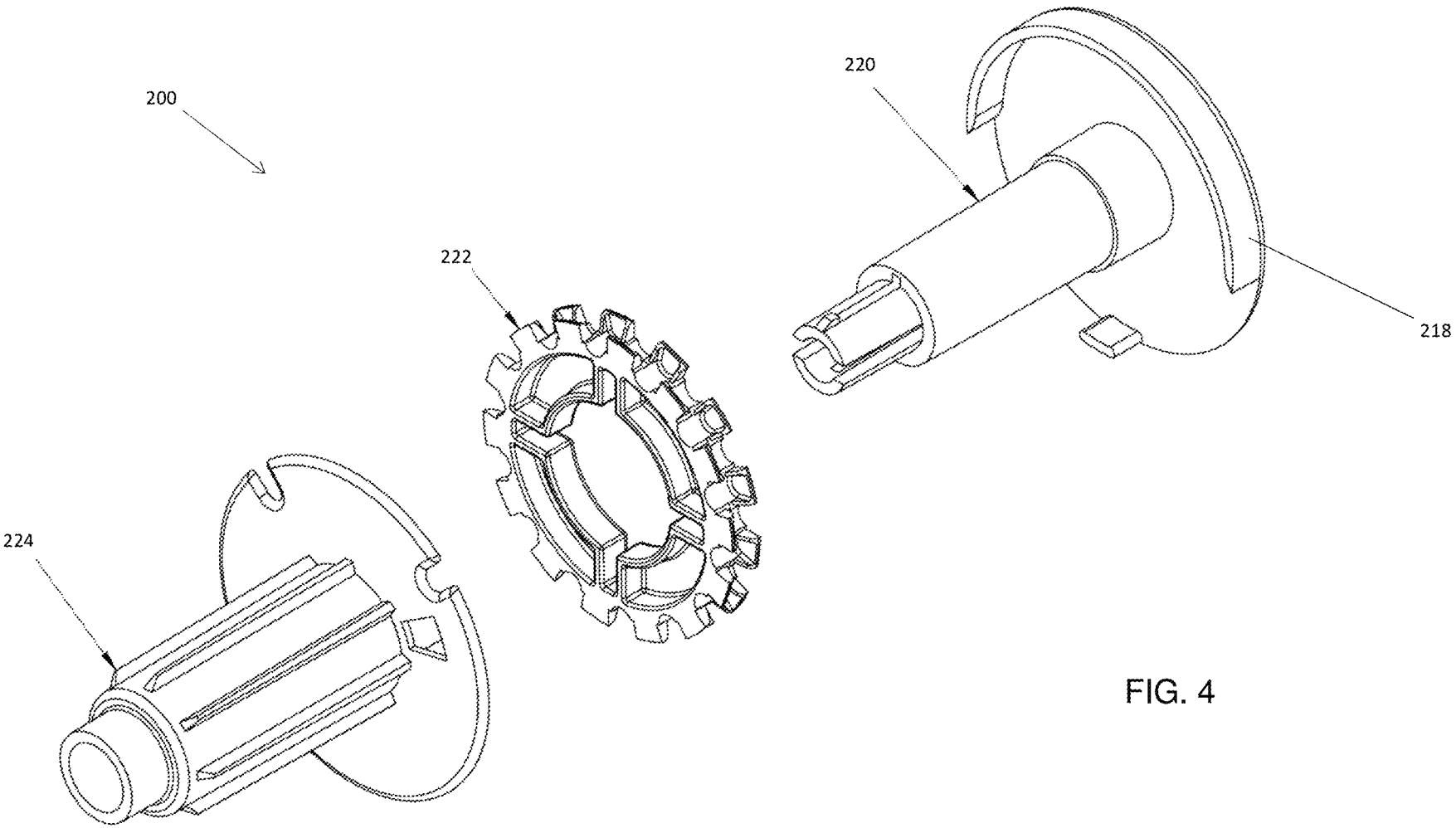
FIG. 4 is an exploded view of the secondary clutch assembly of the roller shade system shown in FIG. 2.

The secondary clutch assembly 200 is shown in an exploded view in FIG. 4. the secondary clutch assembly 210 includes a sprocket 222 having an outer sprocket cover 218 with an extruded stem 220 and an inner sprocket cover 224. The secondary clutch 210 is assembled by mating the sprocket 222 onto the outer sprocket cover 218 and placing the inner sprocket cover 224 over the sprocket 222. The secondary clutch assembly 200 may then be inserted into an end of the hollow tube 102 that is opposite the clutch assembly 103. The secondary clutch assembly 200 is therefore similar to the primary clutch assembly 103 but without having a brake spring 306. It may be noted that as shown in FIG. 2, typically only one clutch includes a braking mechanism, in this case the primary clutch assembly 103. This is because since the braking force is/can be adjusted by compressing the spring more or less with a bolt, using a pair of springs adds additional steps for adjusting and tweaking the system 10. Using a pair of brakes also increases the cost of the system due to an extra spring being required for braking. It may be noted that a pair of brakes can still be used if costs and/or ease of adjustment are not of as high a concern.

As noted above, the secondary clutch assembly 200 can be replaced with an idle end 106. The idle end 106 is shown in greater detail in FIG. 5. The idle end 106 can be used to reduce cost by only requiring a primary clutch assembly 103. The idle end 106 can also be used according to the requirements for a light gap between the shade and the edges of the window 20. However, this can cause an imbalance in light gaps on each side. The idle end 106 is also suitable for use in motorized systems. The idle end 106 includes an inner idle end 320, and an outer idle end 322. The inner idle end 320 includes a snap fitting 324 that secures the inner idle end 320 within the outer idle end 322 when inserted therein, by mating with a distal end 326 of the outer idle end 322. The idle end 106 is inserted into the hollow tube 102 at the end opposite that of the clutch 103 and enables that end of the hollow tube 102 to be secured to, and rotate relative to the assembly 10.

Figure 6:
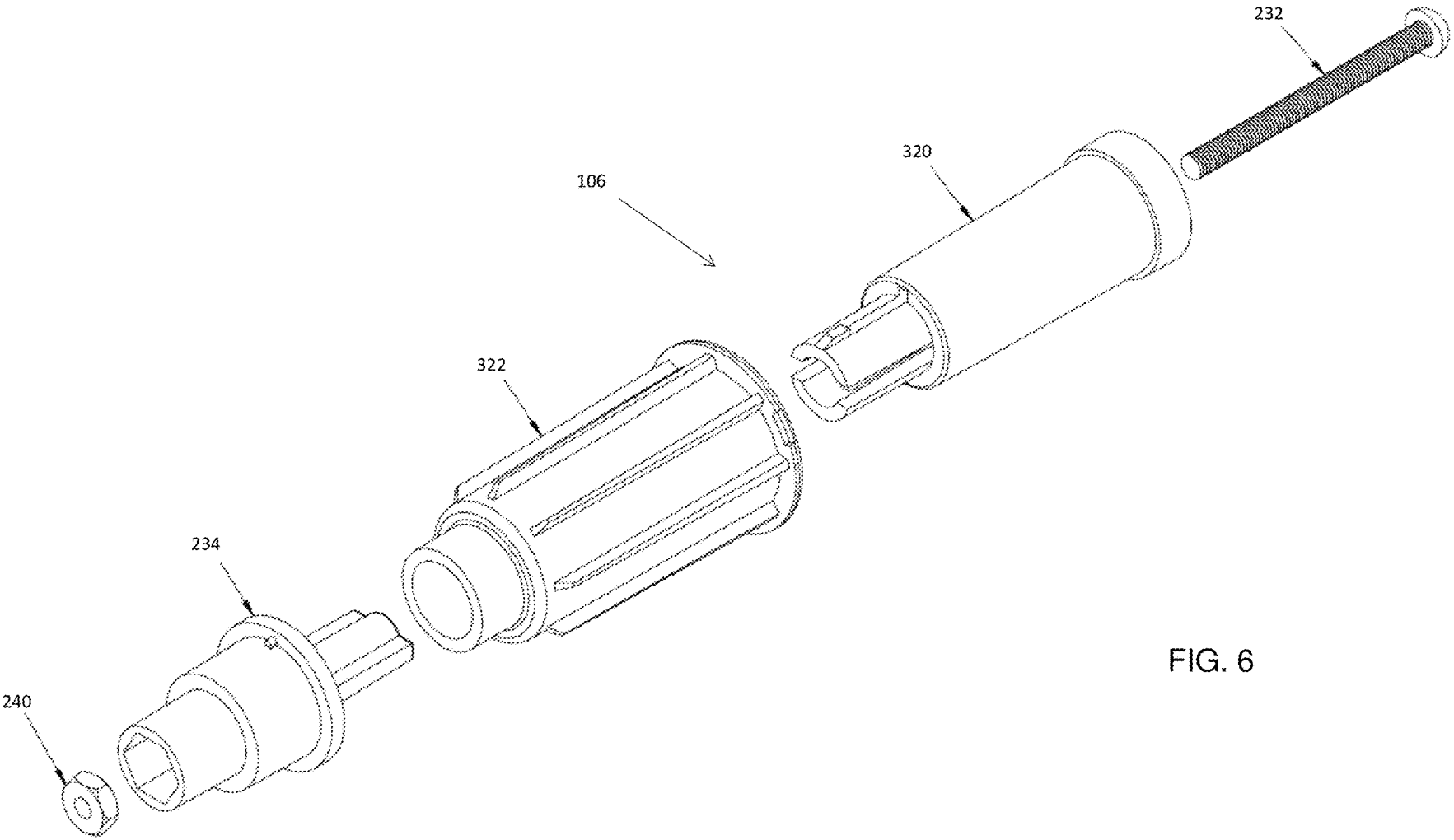
FIG. 6 is an exploded view of an idle end lift assist mechanism assembly.

FIG. 6 illustrates how the idle end 106 can be mated with, for example, the lift assist mechanism 210. The outer idle end 322 can be mated with an end connector 234 that is suitable for use with a lift assist mechanism 210 or an internal limit setter 900 (see FIG. 22). In this way, the idle end 106 can be interchanged with a secondary clutch assembly 200 in different configurations without requiring additional parts to be manufactured in order to accommodate the different configurations. It can be appreciated that the end connector 234 is also shaped to enable a brake spring 306 to be used at the idle end, if so desired. The components shown in FIG. 6 are assembled using a fastening bolt 232 that is fed through a common centrally aligned aperture and secured using a nut 240.

Figure 7C:
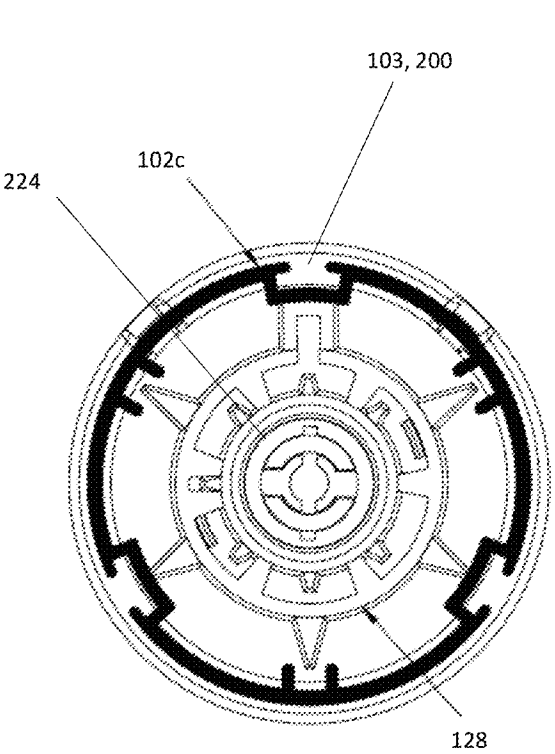
FIGS. 7(*a*) to 7(*c*) illustrate tube fittings for the clutch assemblies to interface with different tube sizes.
Figure 7B:
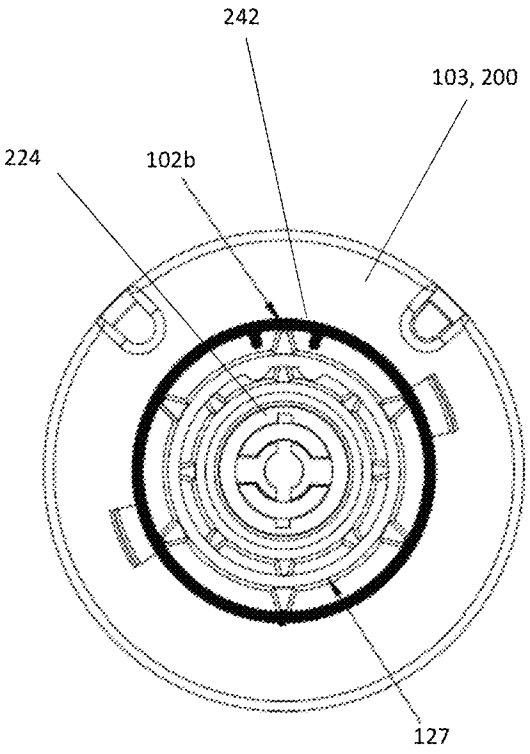
Figure 7A:
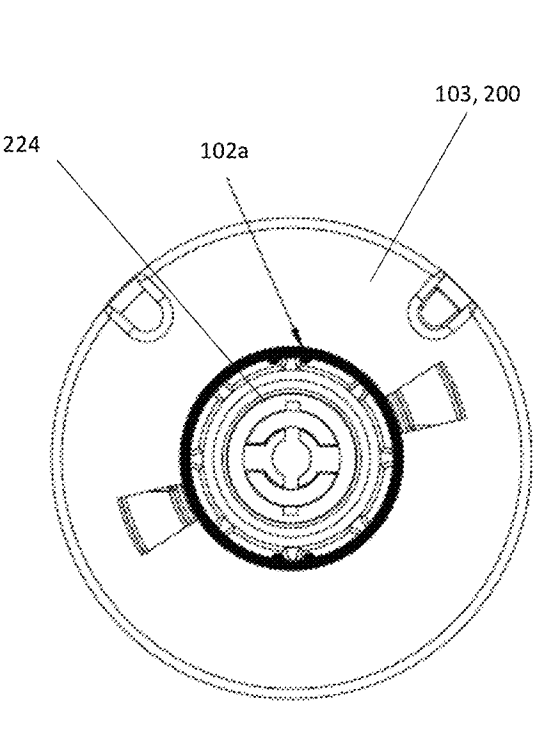

FIGS. 7(*a*) to 7(*c*) provide end views of differently sized tubes 102*a*, 102*b*, 102*c*. In FIG. 7(*a*) a first size of tube 102*a* is sized to provide a snug fitment with the inner sprocket cover 224 of a clutch assembly 103, 200 in this example. It can be appreciated that a similar fitment is provided by the outer idle end 322. In order to accommodate large tube diameters without having to resize the inner sprocket cover 224 and/or outer idle end 322, the tube adapters 127 or 128 can be used. FIG. 7(*b*) illustrates the use of a first relatively smaller tube adapter 127, which is interposed between the inner sprocket cover 224 and the tube 102*b*. Similarly, FIG. 7(*c*) illustrates the use of a relatively larger tube adapter 128 also interposed between the inner sprocket cover 224 and the tube 102*c*. The tubes 102*a*, 102*b*, 102*c* each include at least one groove, ridge or suitable interface profile 242 that interacts with a complementary profile on the exterior surface of the inner sprocket cover 224. This ensures that the inner sprocket cover 224 rotates with the tube 102 as the fabric 100 is raised and lowered.

Figure 8:
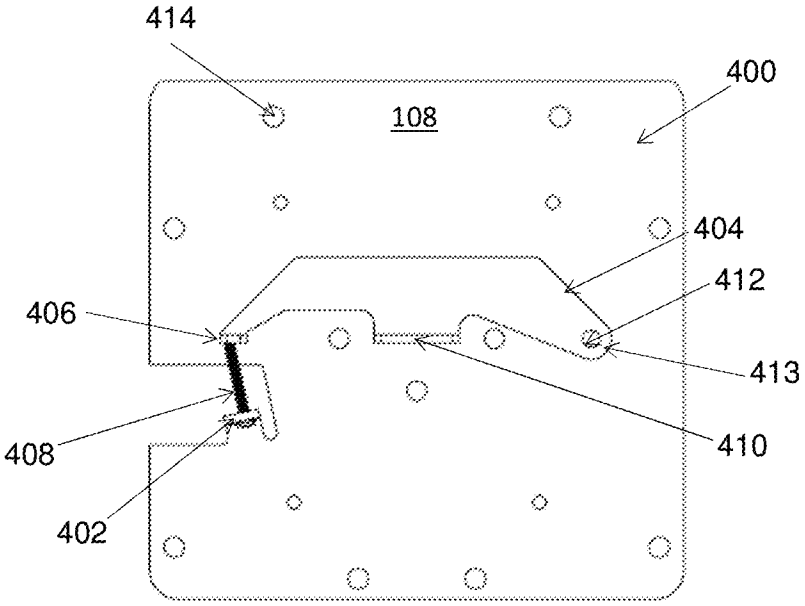
FIG. 8 is a front view of a leveling mechanism of the roller shade system shown in FIG. 1.

As noted above, a leveling mechanism 108 is attached to each of the clutch assemblies 103, 200 and/or to both a clutch assembly 103 and idle end 106. As seen in FIG. 8, the leveling mechanism 108 includes a baseplate 400 having a flange 402. The flange 402 has a passage formed by an aperture through its centre to support an adjustment member such as leveling screw 408. The flange 402 is therefore located at an appropriate distance from a leveling bar 404. The leveling bar 404 is affixed to the central portion of the plate 400 via a pivot 413 at an end opposite to the flange 402. The pivot 413 is formed by attaching the leveling bar 404 to the plate 400 via a fastener, such as a pin, through an aperture 412. The aperture 412 is therefore situated at an end opposite to the flange 402. The leveling bar 404 includes a protrusion 406 aligned with the flange 402 to enable the leveling screw 408 to bear against the protrusion 406 to adjust the angular orientation of the leveling bar 404 with respect to the plate 400. In this way the roller shade can be leveled by adjusting the adjusting screw 408. The leveling bar 404 also includes a mantle 410 situated at or near its centre. The mantle 410 supports one end of the tube 102 through the clutch assembly 103 and idle end 106 respectively. As the leveling screw 408 contacts the protrusion 406 on the leveling bar 404, threading the leveling screw 408 through the flange 402 causes the tip thereof to push against the protrusion 406 on the leveling bar 404, causing the leveling bar 404 to rotate about the pivot 413. Pivoting the leveling bar 404 also causes the mantle 410 to be raised or lowered, which in turn causes the tube 102 to be raised or lowered at the corresponding end. The plate 400 further comprises a plurality of holes 414 which allow for passage of fasteners such as socket screws 112 through them.

It will be appreciated that the leveling mechanism 108 can be implemented with variations to the particular components shown in FIG. 8. For example, the leveling screw 408 can be embodied as a screw or bolt or other threaded member which can be advanced or retracted to operate on the leveling bar 404. The mantle 410 can also be embodied by any suitably shaped or contoured portion of the leveling bar 404 and may be integral thereto or a separate component. The positioning of the leveling screw 408 enables convenient adjustment of the tube 102 in situ, without requiring a bulky mechanism, and without taking away from the coverage provided by the fabric 100.

As shown in FIGS. 1(*a*), 1(*b*), 2, and 9, the modular valance assembly 114 can include a plurality of valance members which can also be referred to as fascia. In the example shown in FIG. 1(*a*), a front fascia 116, a rear fascia 117, a bottom fascia 118, and a pair of assembly brackets 122 are used to enclose the cassette. As discussed above, the valance assembly 114 may alternatively have a top fascia 124 that also forms or otherwise includes the assembly brackets 122 as shown in FIG. 1(*b*).

Figure 9:
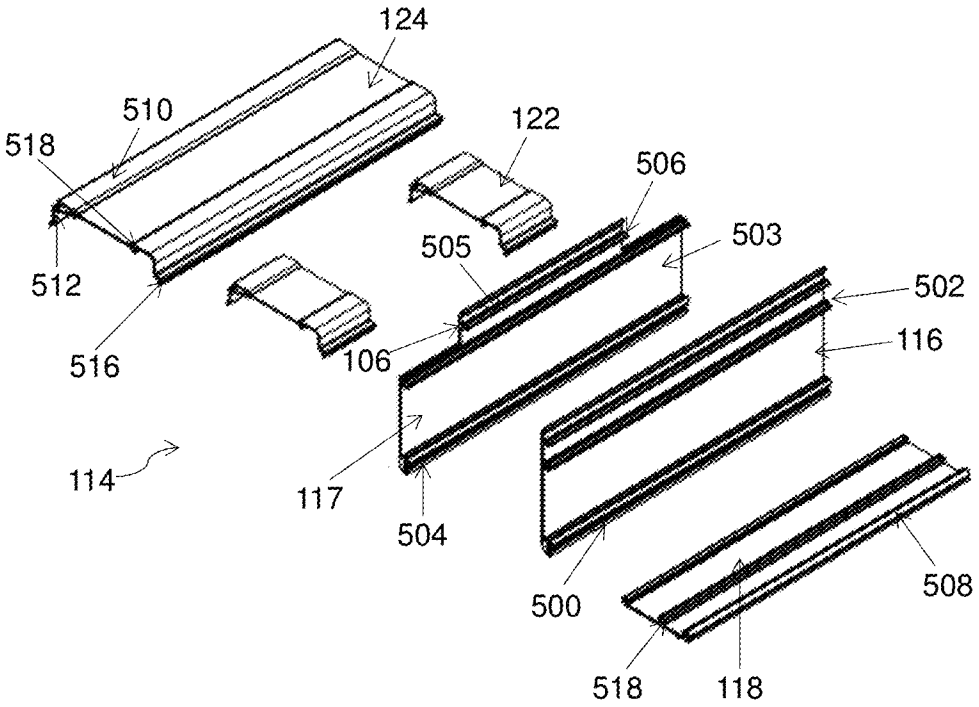
FIG. 9 is an exploded view of a modular valence valance assembly of the roller shade system shown in FIG. 1.
Figure 10A:
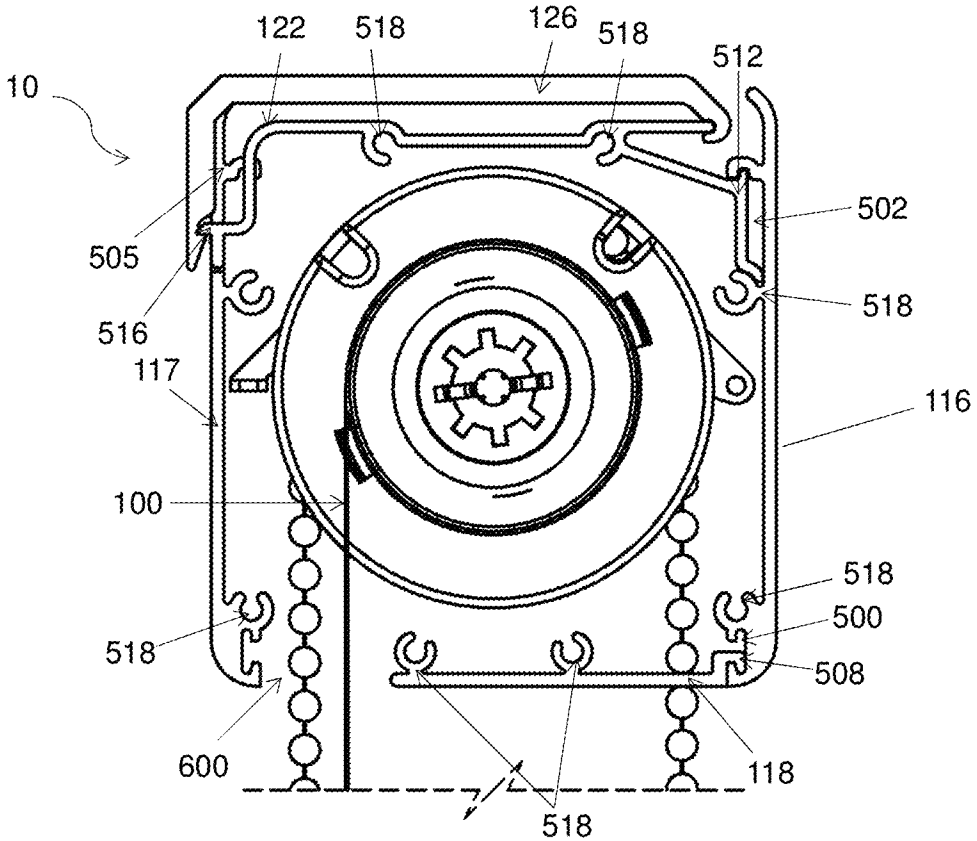
FIG. 10(*a*) is a cross sectional view across A-A of FIG. 1 according to one regular roll valance configuration for the roller shade system.
Figure 10C:
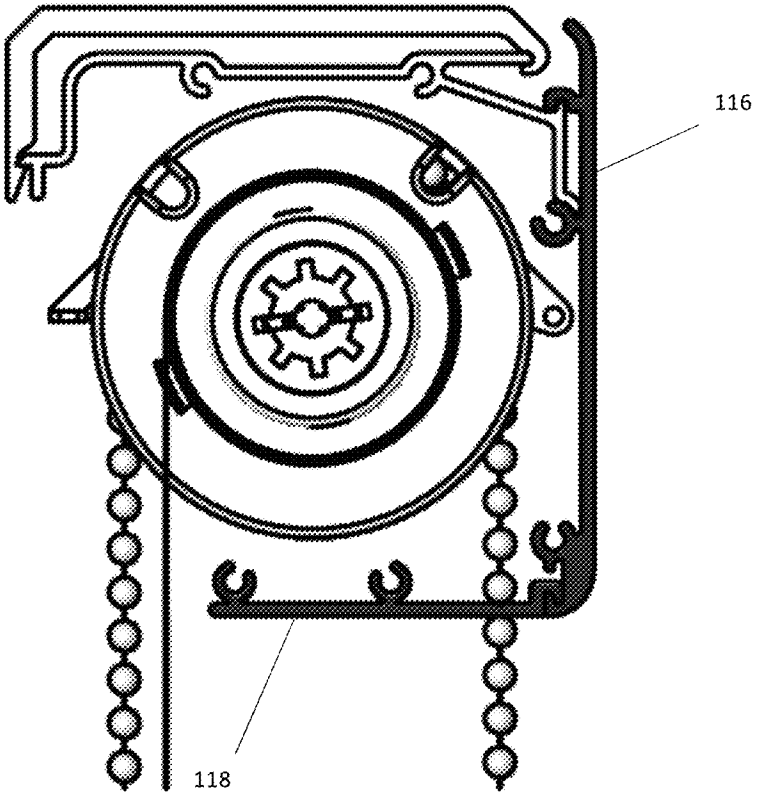
Figure 10B:
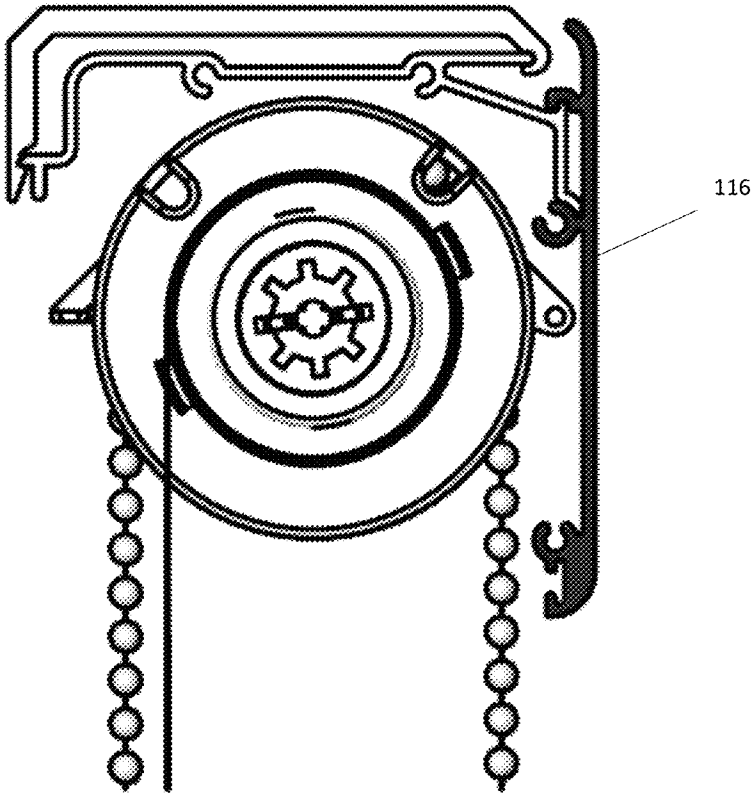

Referring now to FIGS. 9 and 10(*a*), both the assembly bracket 122 and top fascia 124 comprise a cantilevered rib 512 which projects along a longitudinal edge. The opposing edge of the assembly bracket 122 and top fascia 124 each have a projecting rib 516. In between the cantilevered rib 512 and the projecting rib 516 is a socket 518 on each of the assembly brackets 122 and top fascia 124 to allow for the insertion of socket screws 112 into the socket 518. It will therefore be seen that the top fascia 124 and assembly brackets 122 are interchangeable in their use due to their similarity in design. However, the assembly brackets 122 are shorter in length than the top fascia 124 and can be cut from the same extrusion.

The front fascia 116 has a narrow track 500 along its bottom edge and a wide track 502 along its top edge. The tracks 500 and 502 are formed during extrusion of the front fascia. Alternatively it can be seen the front fascia can be manufactured by alternative means such as casting and the tracks 500 and 502 can be formed during casting of the front fascia 116, or from members attached to the front fascia 116 through adhesives or fasteners. The wide track 502 is spaced to fit the cantilevered rib 512. The narrow track 500 is spaced to fit a mounting flange 508 along one longitudinal edge of the bottom fascia 118.

The rear fascia 117 has a base portion 503 and may have a top portion 505 attached to and situated above the base portion 503. The top portion 505 is shorter in length than the base portion 503 and present in roller shade assemblies utilizing an assembly bracket 122 instead of a top fascia 124. Alternatively, in the embodiments utilizing a top fascia 124 the rear fascia 117 can be provided without a narrower top portion 505. The base portion 503 and top portion 505 have their centres aligned. The rear fascia 117 can be formed through extrusion similar to the front fascia 116 and subsequently the top portion 505 is removed as necessary based on the embodiment. A track 504 is situated along the bottom edge of the lower portion which is spaced to fit the mounting flange 508 of the bottom fascia 118.

As stated previously, the bottom fascia 118 has a mounting flange 508 along one longitudinal edge. It will be appreciated that the bottom fascia 118 can have a second mounting flange along the other longitudinal edge as well. The mounting flange 508 can be formed via a bend in the edge of the bottom fascia 118 or by members attached to the edge of the bottom fascia 118. The mounting flange 508 is attached to the track 500 or 504 to securely support the bottom fascia 118 perpendicular to the front fascia 116 or rear fascia 117 respectively.

It will be seen in FIG. 10(*a*) that each fascia member of the valance assembly 114 has a plurality of sockets 518 which allow for the insertion of fasteners such as socket screws 112.

The outer face of both the assembly brackets 122 and top fascia 124 are able to clasp or clip into the mounting brackets 126. This is achieved by inserting the projecting rib 516 into a notch in the mounting brackets 126 and then pushing the top face of either the assembly bracket 122 or top fascia 124 into the mounting bracket 126. Therefore, the assembly brackets 122 or top fascia 124 can be attached to a mounting surface to support the roller shade system 10 via the mounting brackets 126. The mounting brackets 126 can be attached to a mounting surface through the use of fasteners such as screws 128 that pass through slots 130 on the mounting brackets 126 and into the mounting surface.

Since the valance assembly 114 is modular, it can be appreciated that the modular valance assembly 114 can be modified to suit roller shade systems of both the regular roll and reverse roll variety.

As shown in FIG. 10(*a*), to suit a regular roll type roller shade system 10, the bottom fascia 118 is joined to the front fascia member 116. This is achieved by mating the mounting flange 508 of the bottom fascia 118 to the track 500 of the front fascia 116. In this configuration, an opening 600 is formed between the bottom fascia 118 and rear fascia 117. The fabric 100 of a regular roll roller type shade system 10A is able to pass through the opening 600 and can be raised or lowered to cover the window 20 as desired. FIG. 10(*a*) shows one particularly implementation having front, rear, and bottom fascia 116, 117, 118, however, other configurations are possible. For example, only a front fascia 116 may be used, as shown in FIG. 10(*b*), or both a front fascia 116 and bottom fascia 118 without the rear fascia 117 as shown in FIG. 10(*c*). These different configurations allow customization regarding what coverage of the internal mechanisms is required or desired for a particular application.

Figure 11B:
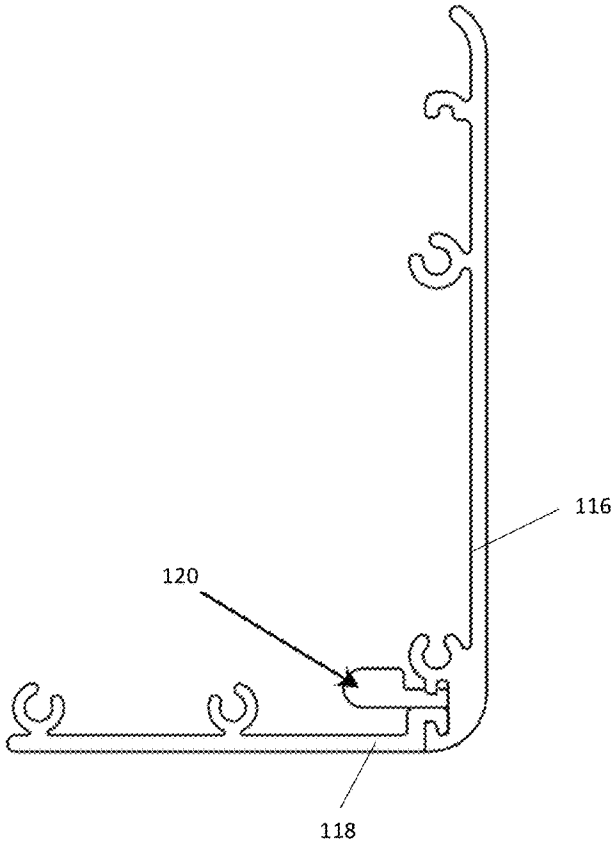
FIG. 11(*a*) is a partial perspective view illustrating assembly of a rubber spline with the modular valance fascia.
Figure 11A:
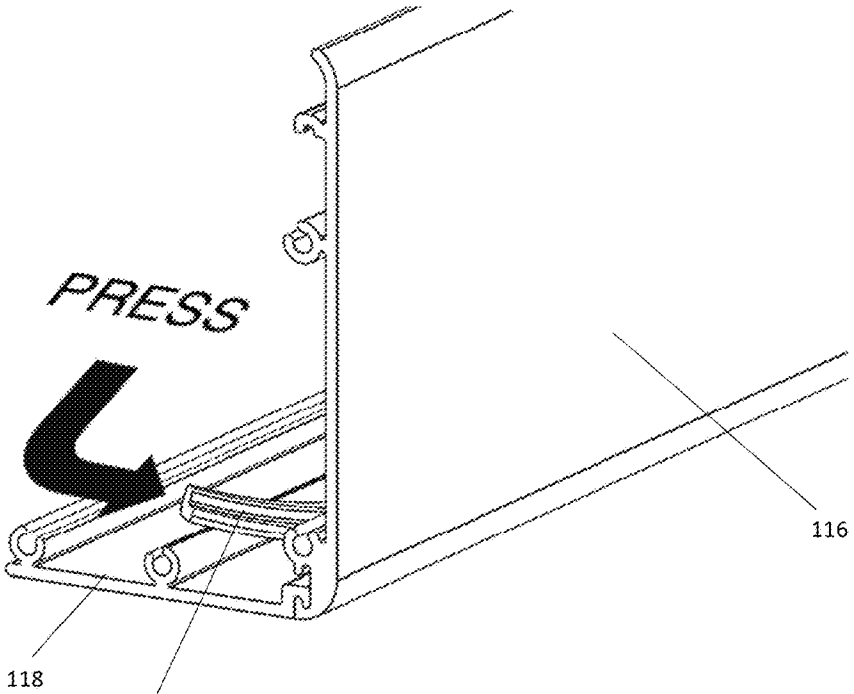

As best seen in FIGS. 11(*a*) and 11(*b*) one or more splines 120, which can be composed of rubber or plastic, may be wedged between the mounting flange 508 and track 500 or 504 respectively to provide further support and reduce vibrations. FIG. 11(*a*) illustrates installation of a spline 120 by pressing it between the front and bottom fascia 116, 118. FIG. 11(*b*) illustrates the fitment of the spline 120 accordingly. It can be appreciated that a number of splines 120 can be inserted along the length of the fascia 116, 118. Alternatively, a screw or other element (not shown) can be wedged in the same area to provide similar additional rigidity and support.

Figure 12B:
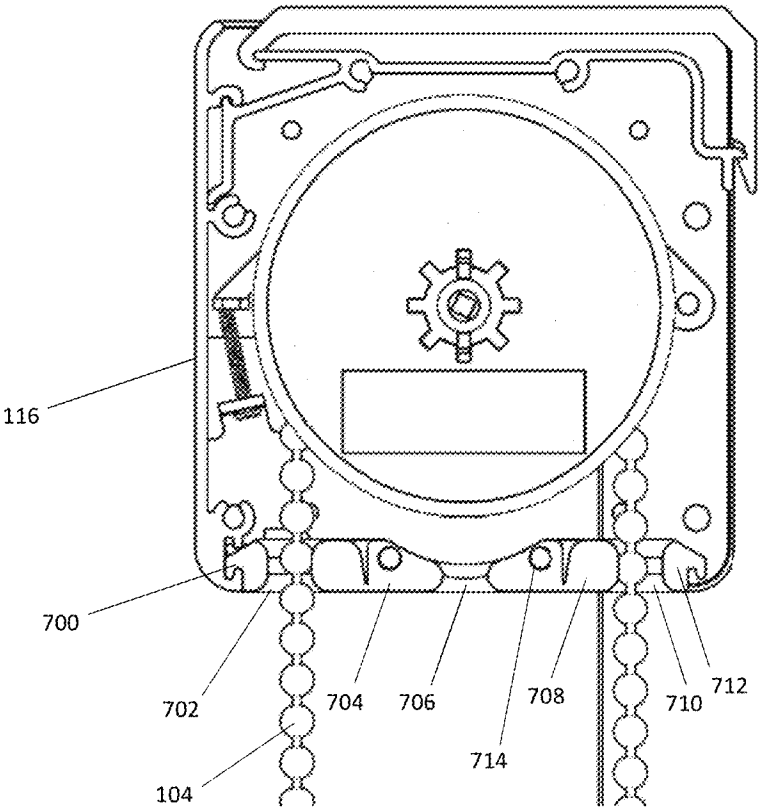
FIGS. 12(*a*) to 12(*c*) illustrate assembly of a chain guard.
Figure 12A:
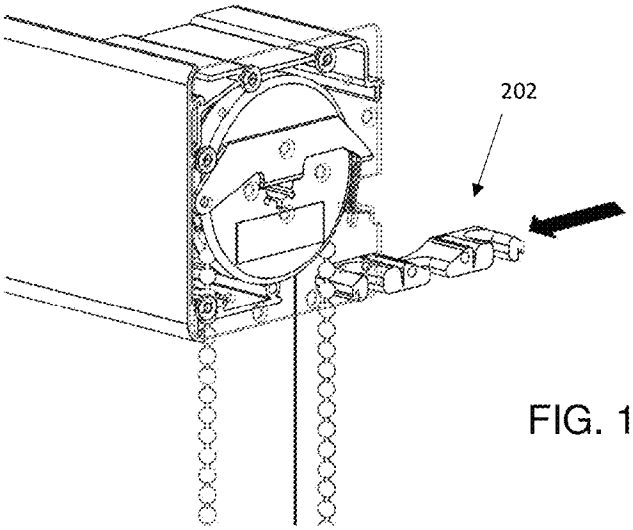
Figure 12C:
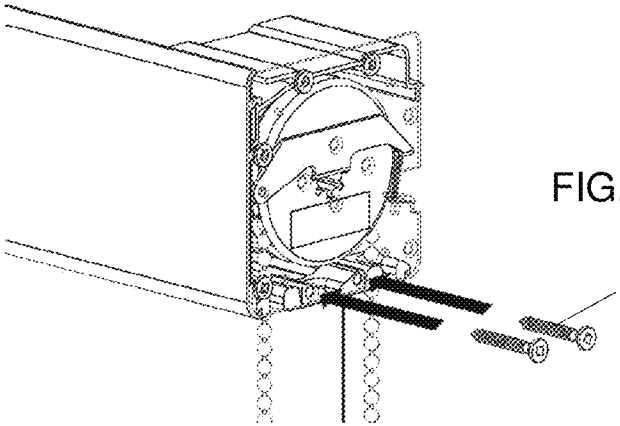

Turning now to FIGS. 12(*a*) to (*c*), further detail regarding the chain guard 202 will now be provided. FIG. 12(*a*) illustrates assembly of the chain guard 202 by feeding it into place at a bottom corner of the cassette and the fitment of the chain guard 202 with the valance assembly 114 is shown in FIG. 12(*b*). As best seen in FIG. 12(*b*), at one end the chain guard 202 has a first tongue 700 that engages a channel in the front fascia 116 in this example. The chain guard 202 is formed from a single piece of material, e.g., a plastic, rubber, metal, etc. and the first tongue 700 extends around a first chain channel 702 to a first central portion 704, which in turn extends around a second centrally located chain channel 706 towards a second central portion 708. The second central portion 708 extends around a third chain channel 710 at the other end towards a second tongue 712. It can be appreciated that the chain guard 202 could instead include apertures or generally any "passage" to achieve the objective of the channels 702, 706, 710 and the exact shape of the chain guard 202 can very within the principles described herein. The first and third channels 702, 710 are aligned with the segments of the chain 104 that hang from the clutch assembly 103 and maintain separation therebetween.

Figure 13B:
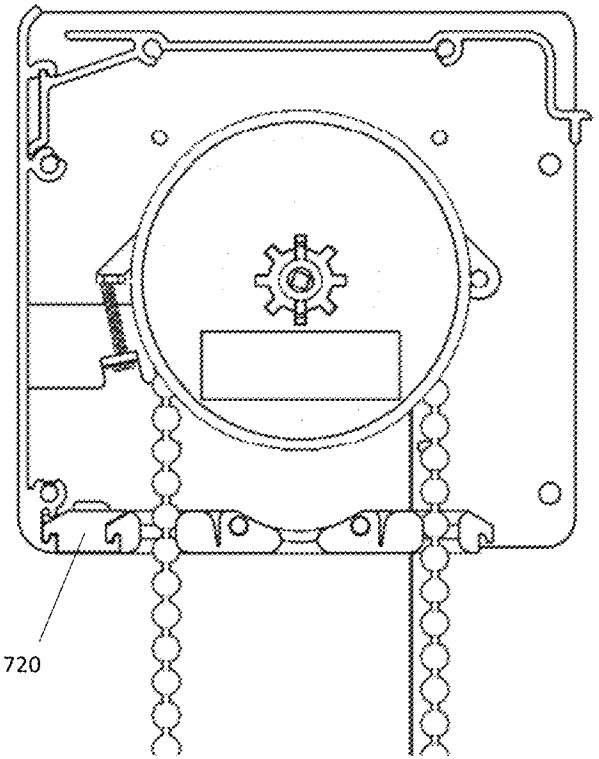
FIGS. 13(*a*) to 13(*c*) illustrate assembly of a chain guard with extender.
Figure 13A:
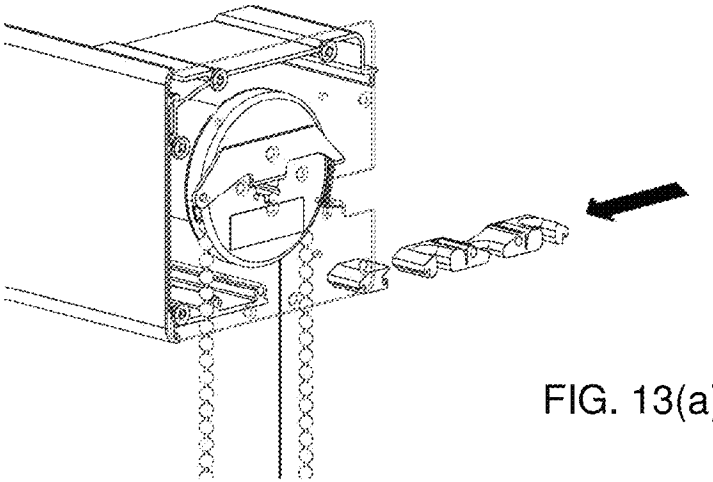
Figure 13C:
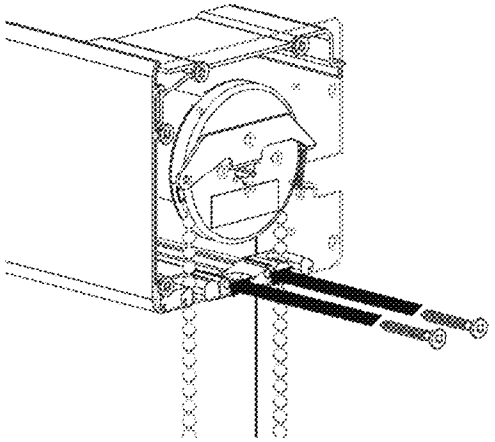

As illustrated in FIGS. 13(*a*) to 13(*c*), the chain guard 202 can be assembled with one or more extenders 720 to accommodate different sizes of cassettes. In this way, the same chain guard 202 can be used with multiple models of the system 10. FIGS. 12(*c*) and 13(*c*) both show that screw holes 714 permit securing the chain guard 202 within the system 10 upon assembly.

Figure 14:
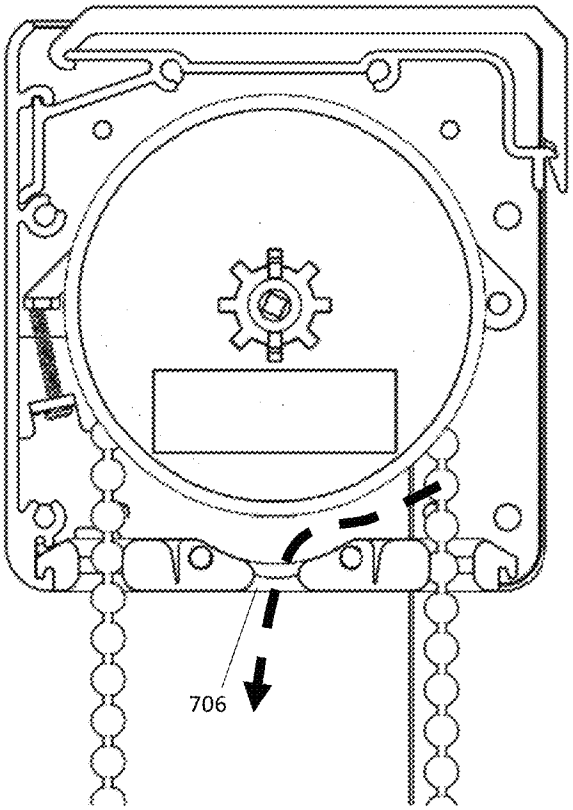
FIG. 14 is a cross-sectional view showing an alternative chain guard configuration for accommodating an obstruction.

FIG. 14 shows that the second chain channel 706 enables one of the segments of the chain 104 to be fed therethrough to change the distance of separation between the chain segments. This flexibility is particularly advantageous when the roller shade system 10 is used with side blackout channels or other obstructions that would otherwise cause the chain to rest against or be interfered with. It is also noted that having tongues 700, 712 at both ends of the chain guard 202 enables the same chain guard 202 to be used in both regular and reverse roll configurations.

Figure 15A:
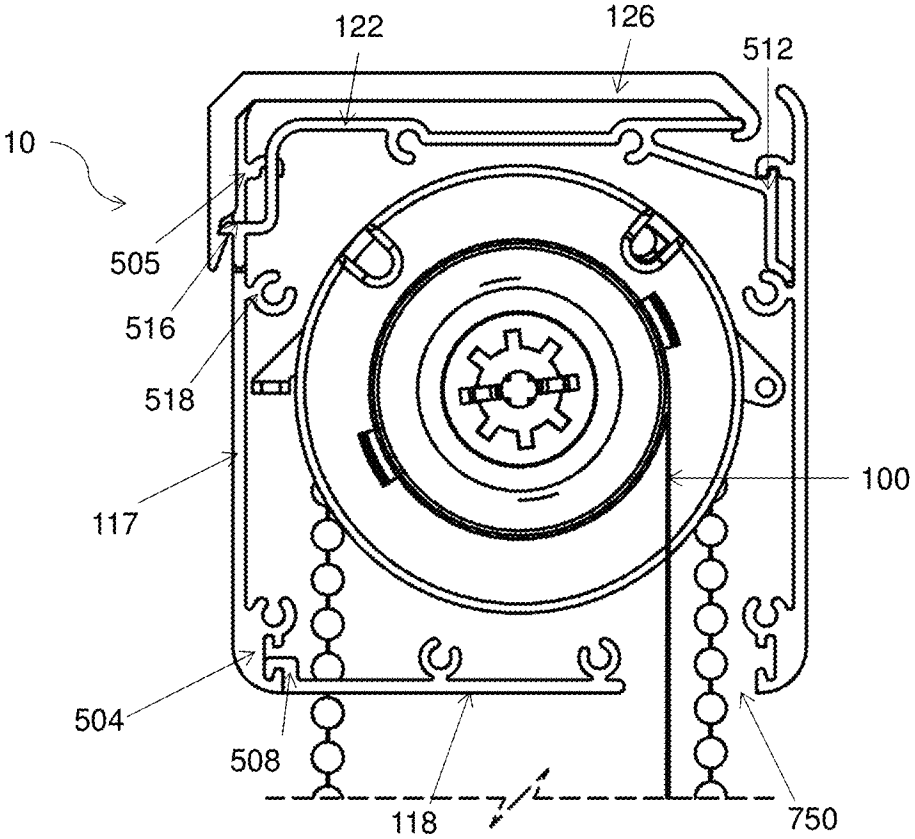
FIG. 15(*a*) is a cross sectional view across A-A of FIG. 1 according to a reverse roll valance configuration for the roller shade system.
Figure 15C:
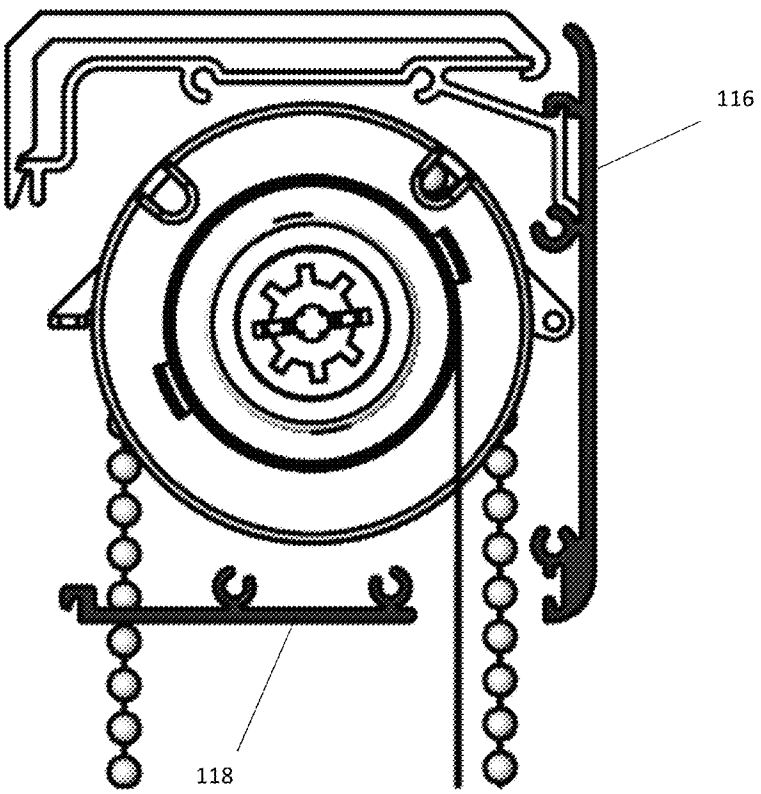
Figure 15B:
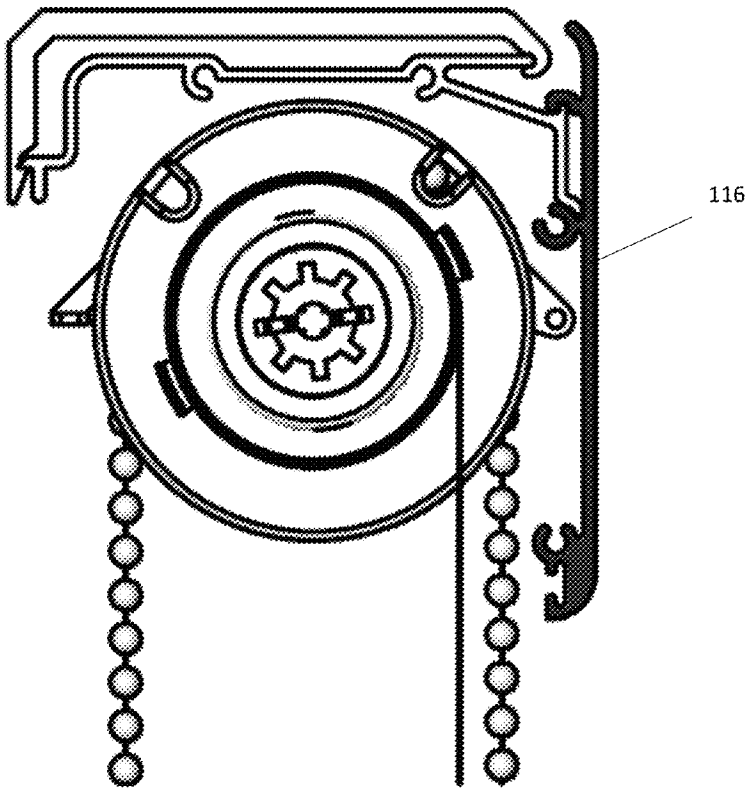

As shown in FIG. 15(*a*), to suit a reverse roll type roller shade system 10, the bottom fascia 118 is joined to the rear fascia member 116. To achieve this, the mounting flange 508 of the bottom fascia 118 is mated to the track 504 of the rear fascia 117. In this configuration, an opening 750 is formed between the bottom fascia 118 and front fascia 116. The fabric 100 of the reverse roll type shade system 10 is therefore able to pass through the opening 750 and can be raised or lowered to cover the window 20 as desired. Similar to FIGS. 10(*b*) and 10(*c*), FIGS. 15(*b*) and 15(*c*) also illustrate that various implementations are possible in a reverse roll configuration.

It will be seen that the modular valance assembly 114 therefore provides adaptability to both regular roll and reverse roll type roller shades. The modular valance assembly 114 can be easily modified to suit both types of configurations quickly and with ease without comprising aesthetics of the valance covering. It will also be appreciated that the modular valance assembly 114 can be adjusted by simply relocating the bottom fascia 118.

Figure 16C:
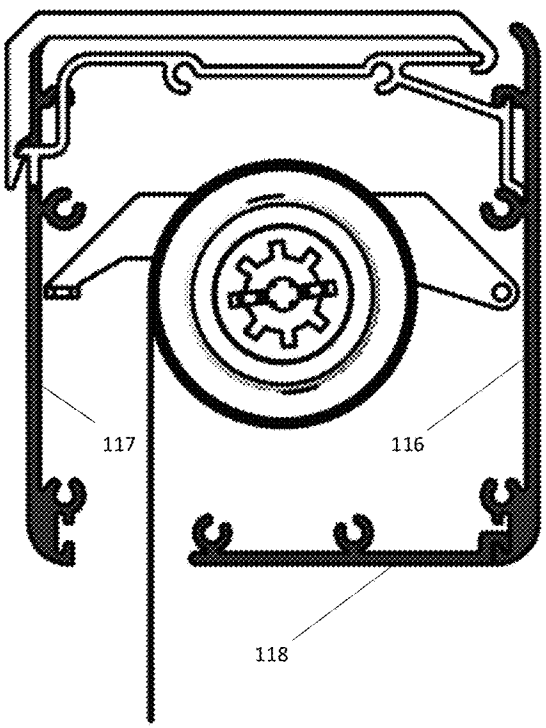
FIGS. 16(*a*) to 16(*c*) are cross-section views of regular roll valance configurations for a chainless roller shade system.
Figure 16B:
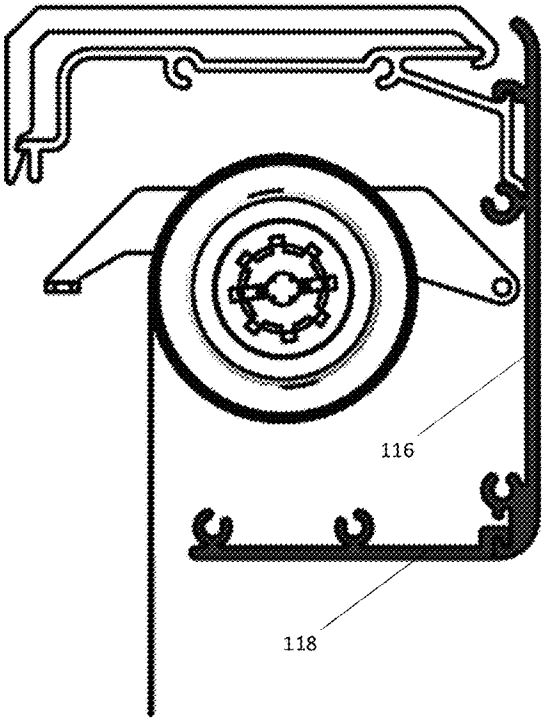
Figure 16A:
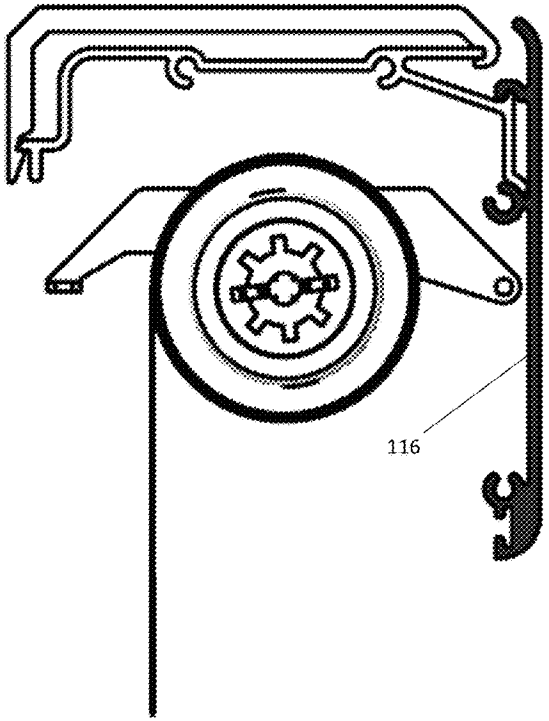
Figure 17C:
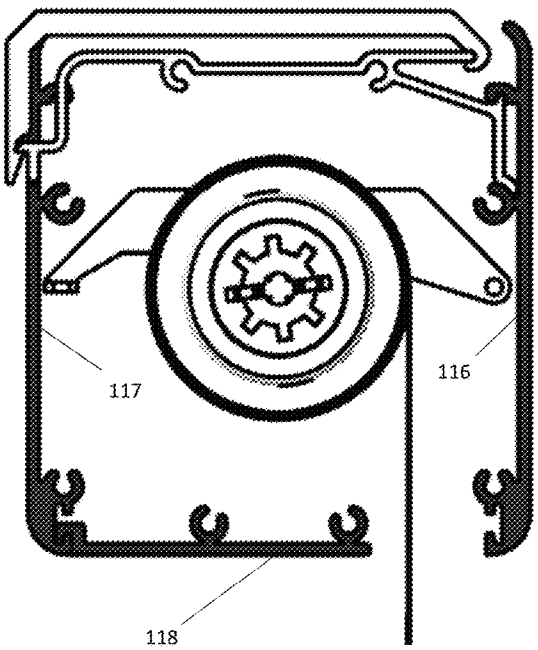
FIGS. 17(*a*) to 17(*c*) are cross-section views of reverse roll valance configurations for a chainless roller shade system.
Figure 17B:
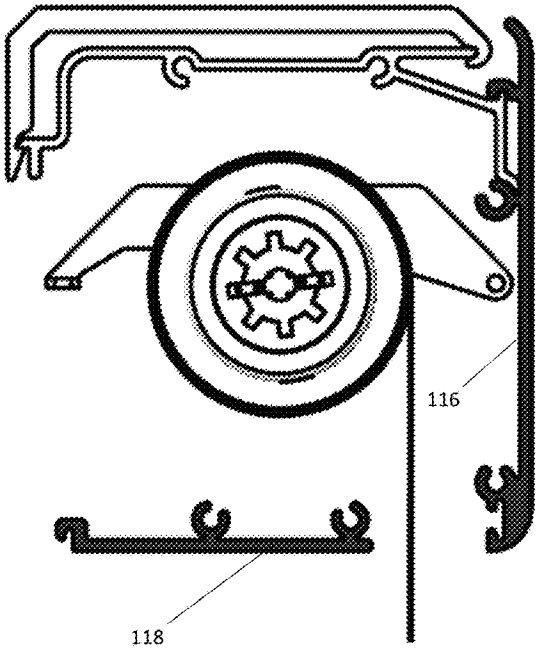
Figure 17A:
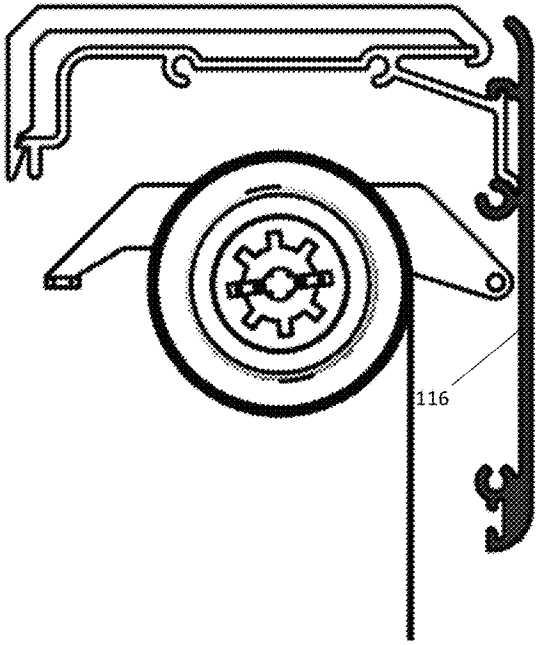

FIGS. 16 and 17 illustrate similar adaptability for a chainless-type roller shade system 10*c*. In FIGS. 16(*a*), 16(*b*), and 16(*c*), a regular roll chainless roller shade system 10 is shown in which the configurations shown in FIGS. 10 and 15 are demonstrated, namely where the system allows for flexibility in incorporating the front, rear, and bottom fascia 116, 117, 118. Similarly, FIGS. 17(*a*), 17(*b*), and 17(*c*) illustrate the same flexibility for a reverse roll chainless system 10.

Figure 18B:
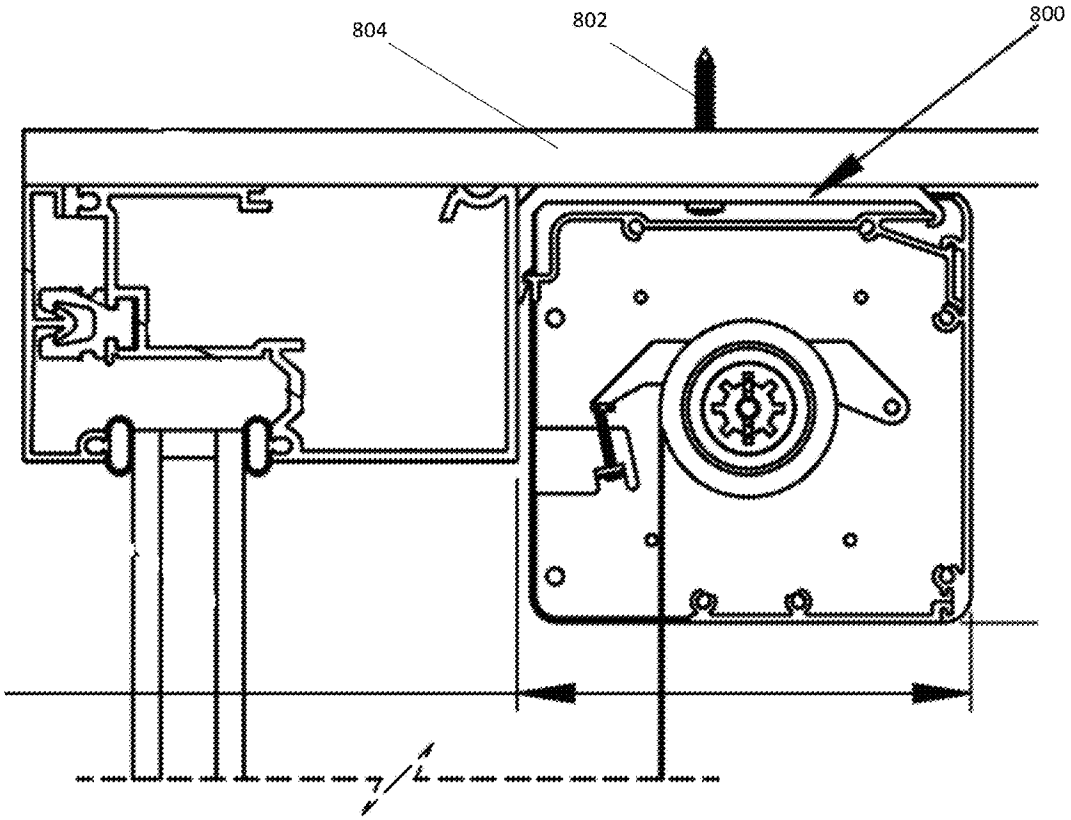
FIGS. 18(*a*) and 18(*b*) illustrate a ceiling-mount mounting bracket configuration.
Figure 18A:
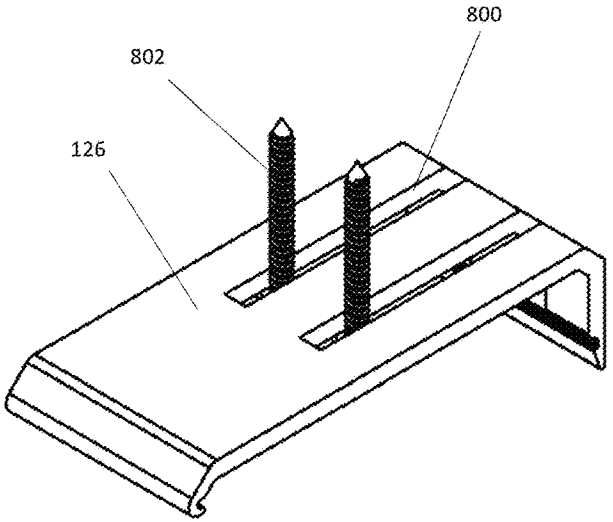
Figure 19B:
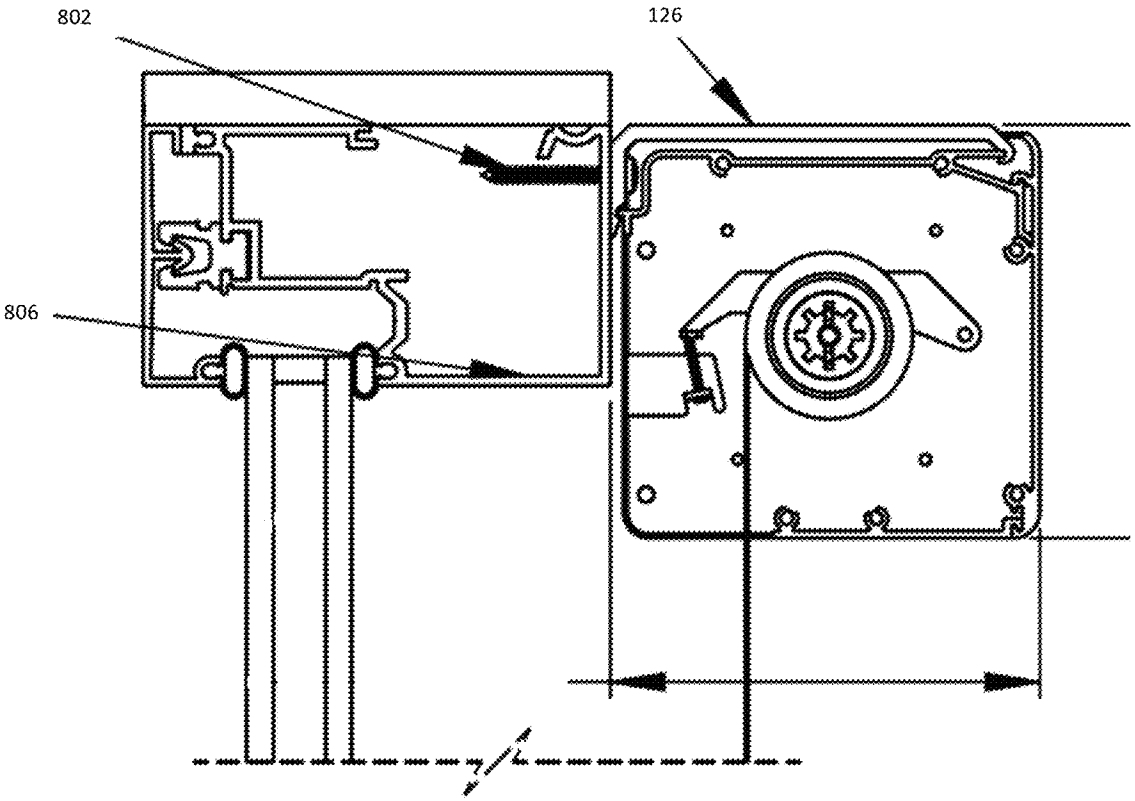
FIGS. 19(*a*) and 19(*b*) illustrate a wall- or face-mount mounting bracket configuration.
Figure 19A:
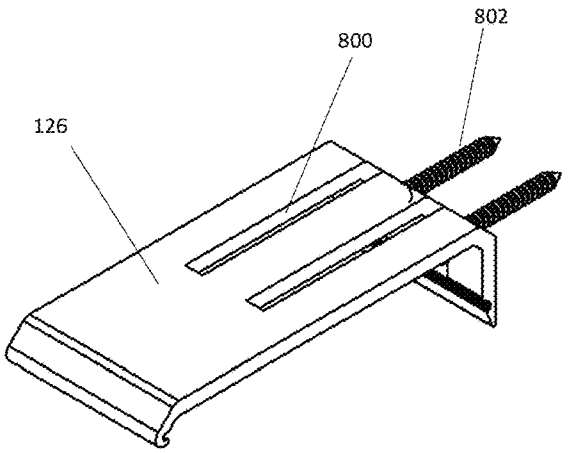

A mounting bracket 126 is shown in FIG. 18(*a*), which includes a pair of I-shaped slots 800 extending in two dimensions. The slots 800 enable fasteners 802 to extend therethrough and can be repositioned therealong. The slots 800 enable multiple mounting configurations to be utilized. For example, as shown in FIG. 18(*b*), with the fasteners 802 extending vertically through the slots 800, the roller shade assembly 10 can be mounted to a ceiling 804 or other horizontally oriented surface. As shown in FIG. 19(*a*), the slots 800 enable the fasteners 802 to be horizontally oriented, thus enabling a wall or face mount configuration as shown in FIG. 19(*b*). In FIG. 19(*b*), the roller shade system 10 is mounted to a mullion 806, however, it can be appreciated that a similar mounting configuration can be used for any suitable vertically oriented surface.

Figure 20B:
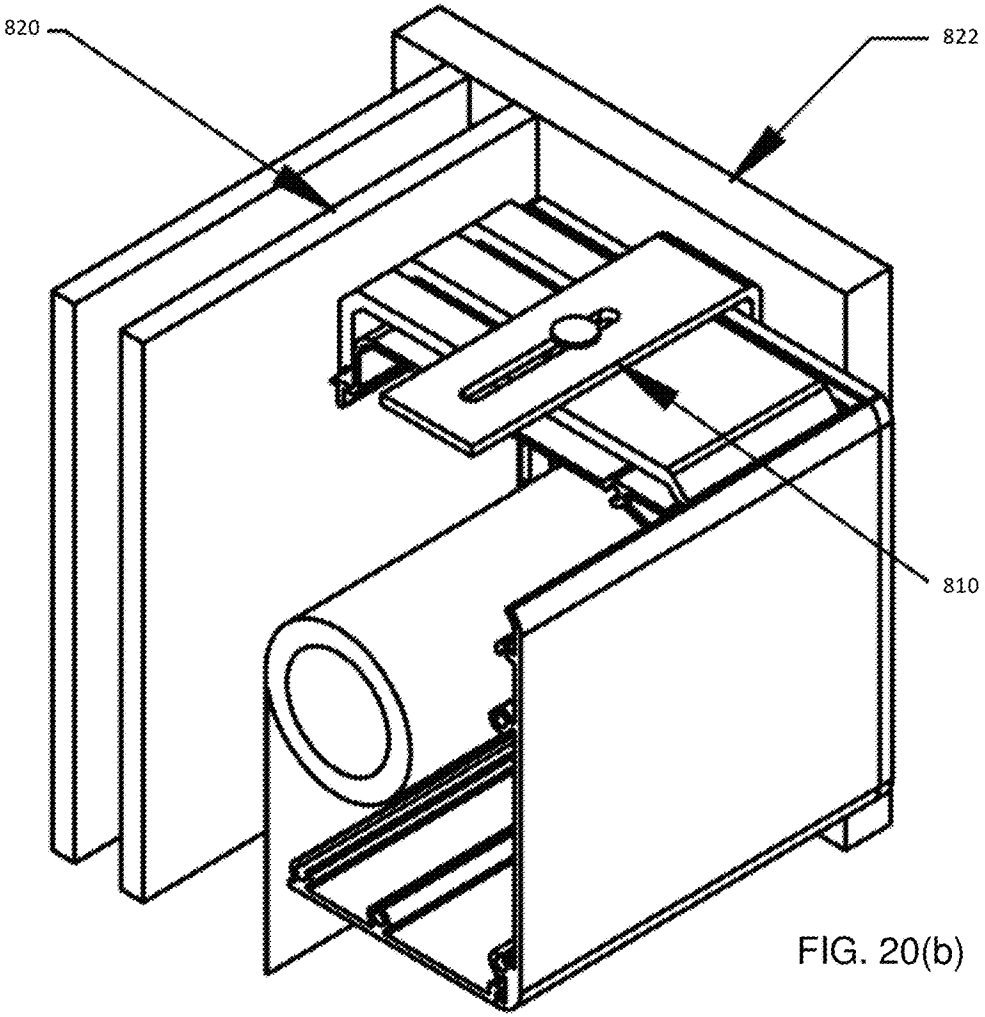
FIGS. 20(*a*) and 20(*b*) illustrate a lateral-mount mounting bracket configuration.
Figure 20A:
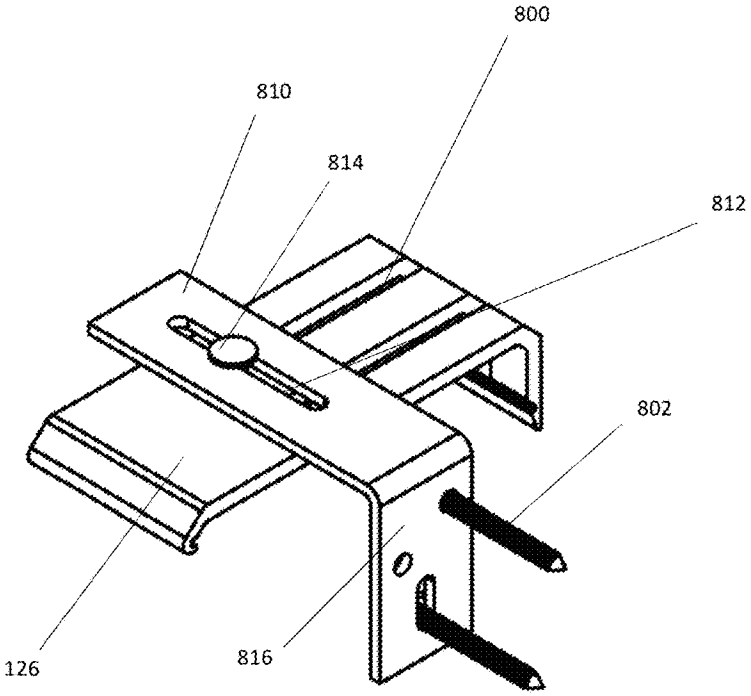
Figure 21A:
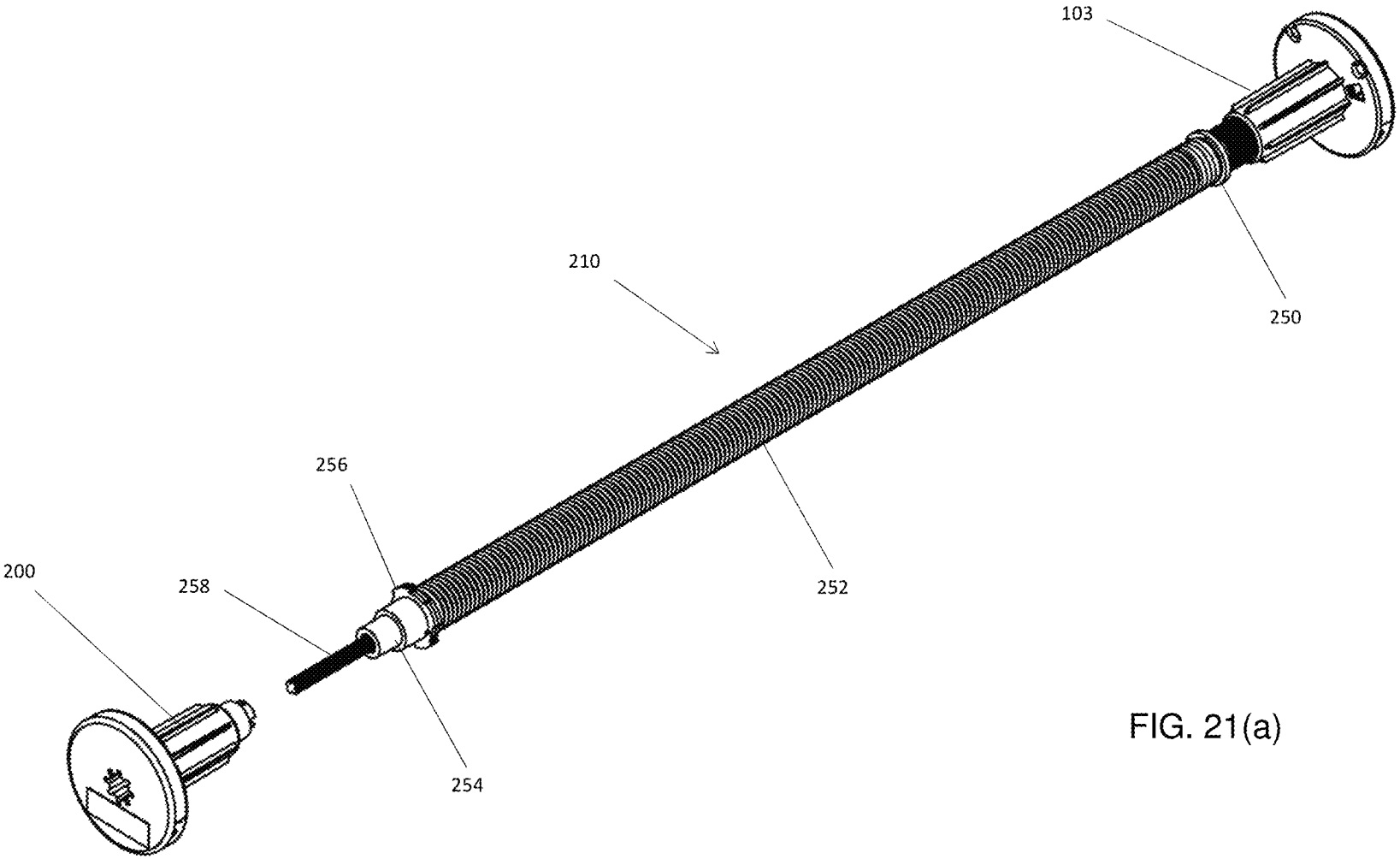
FIGS. 21(*a*) through 21(*f*) are perspective views of lift assist mechanism assembly configurations.
Figure 21B:
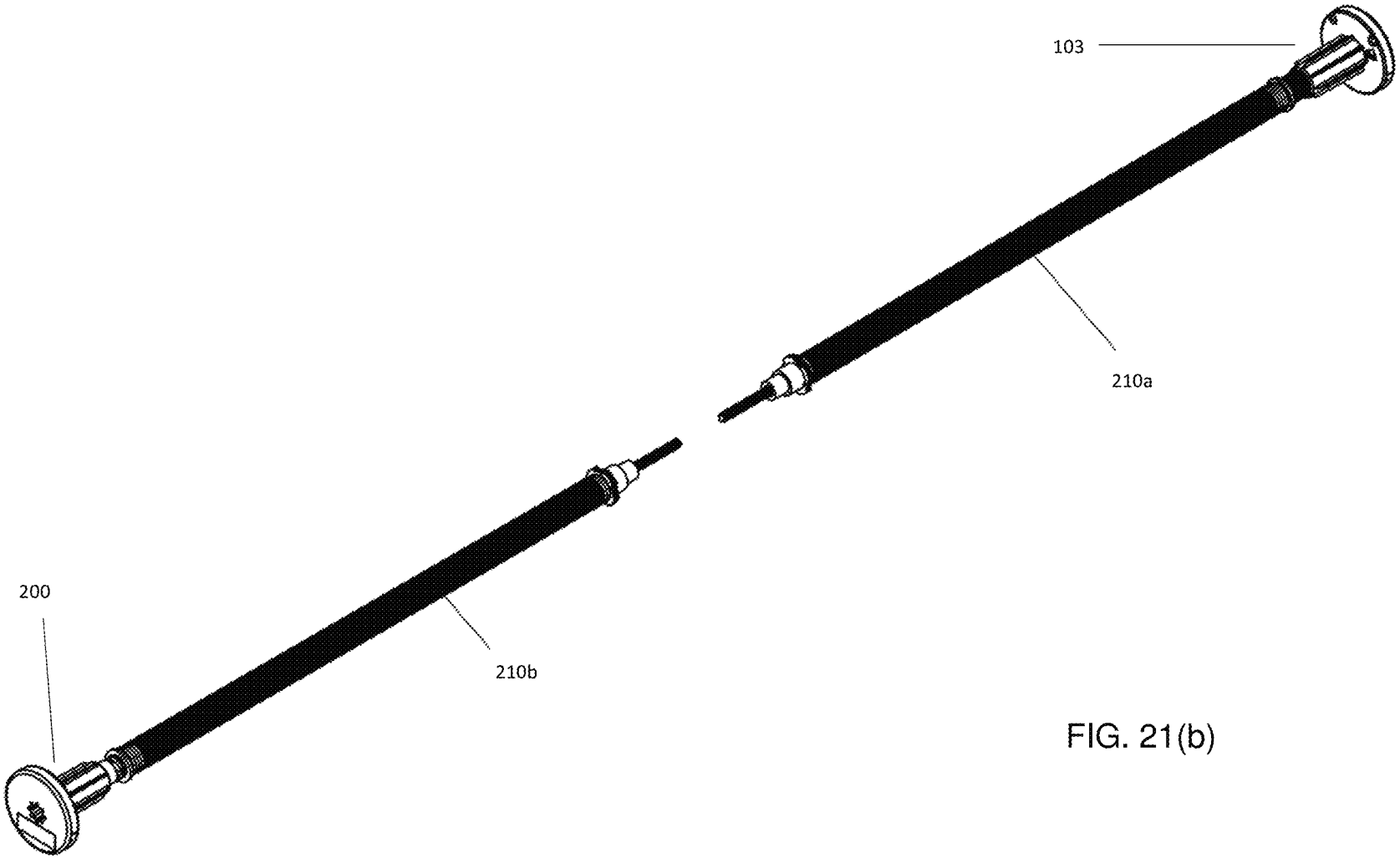
Figure 21C:
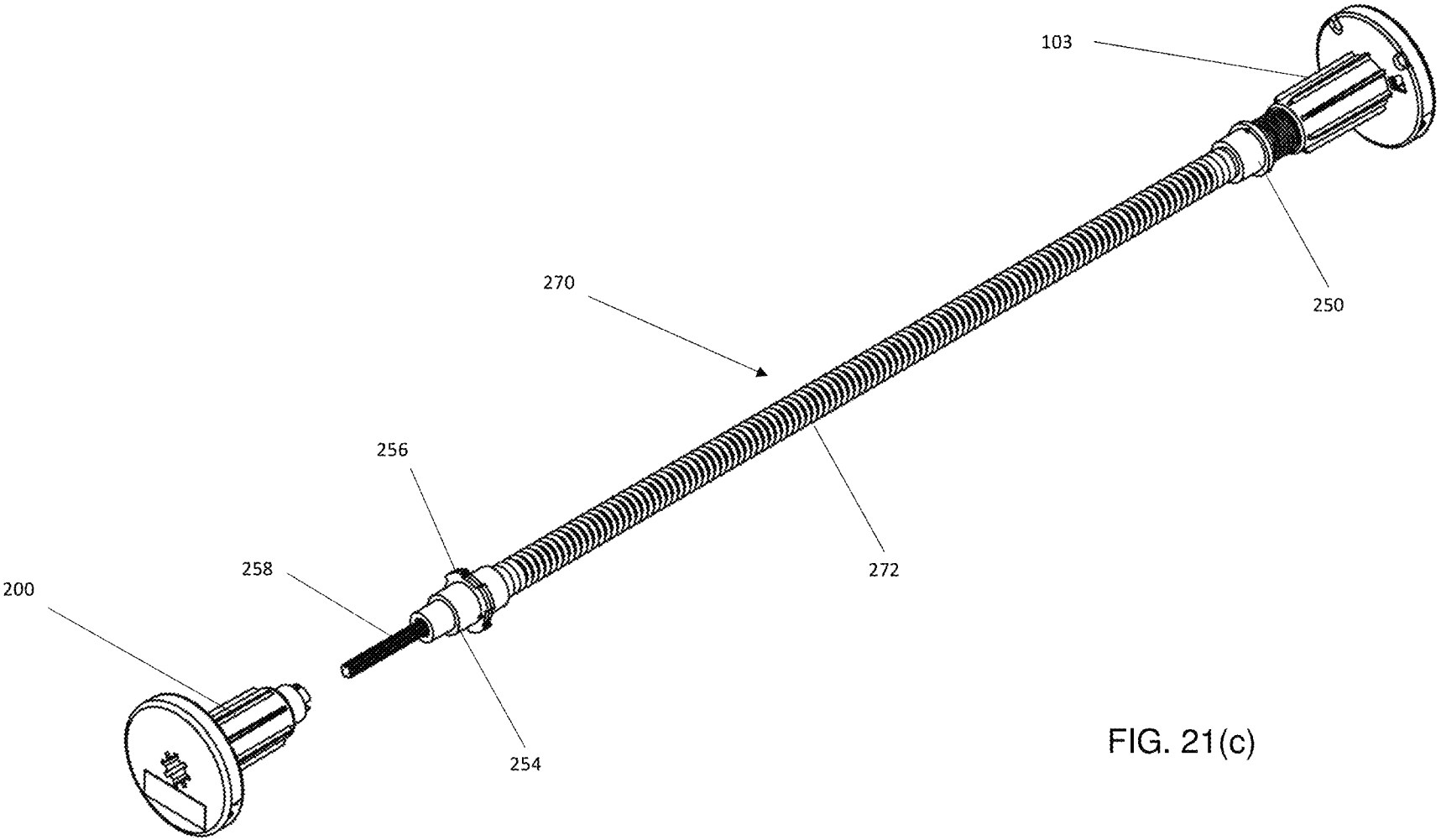
Figure 21D:
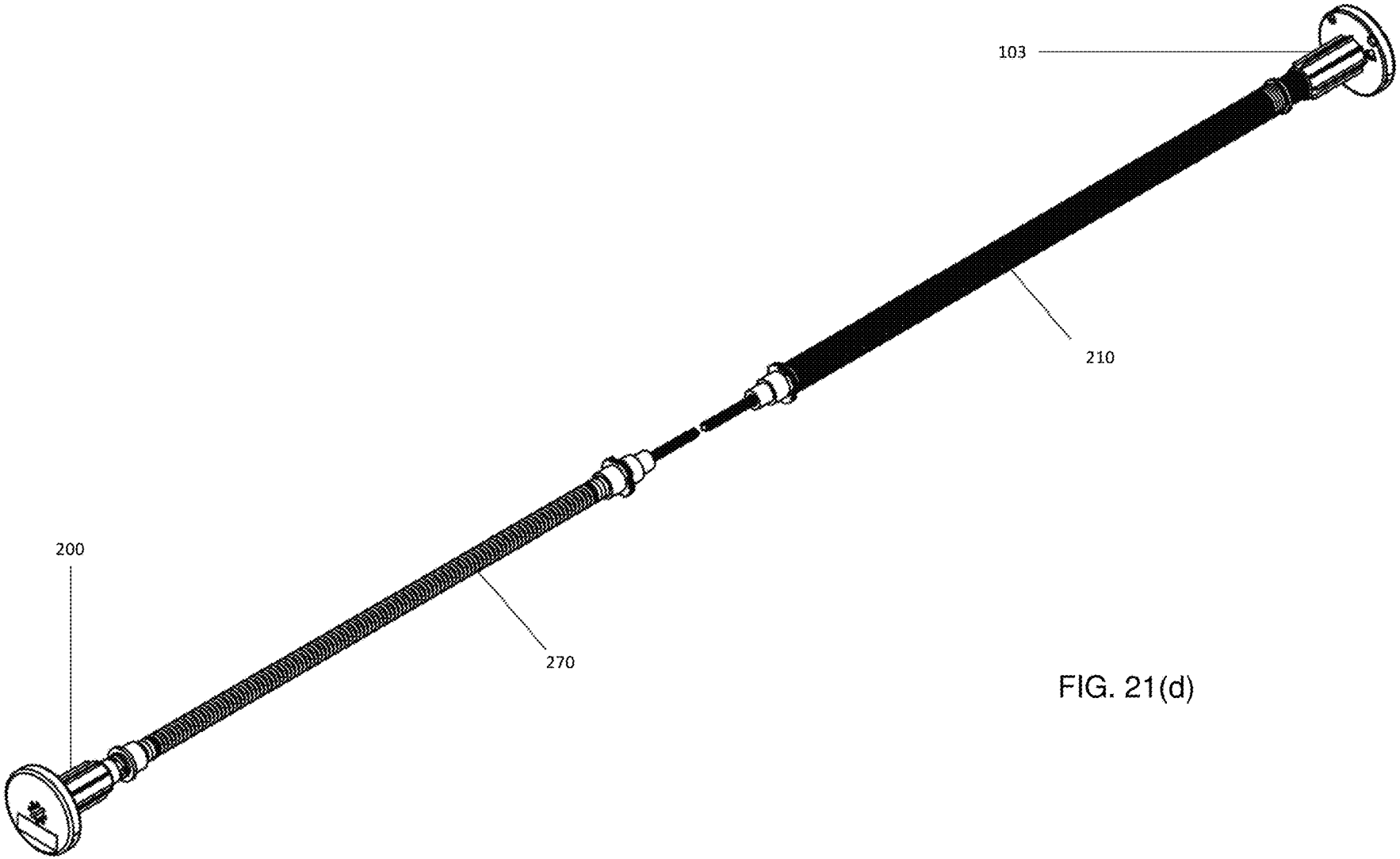
Figure 21E:
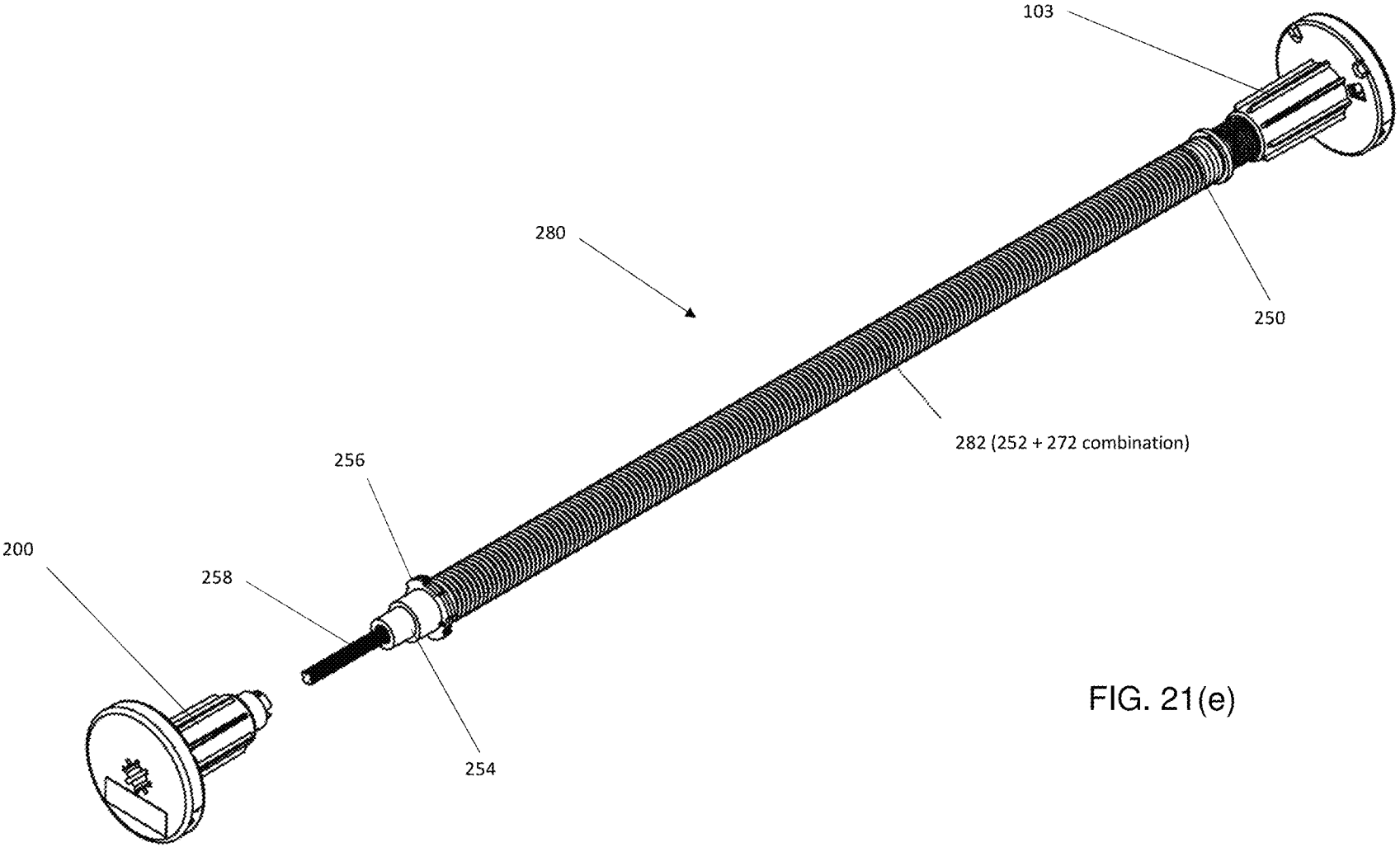
Figure 21F:
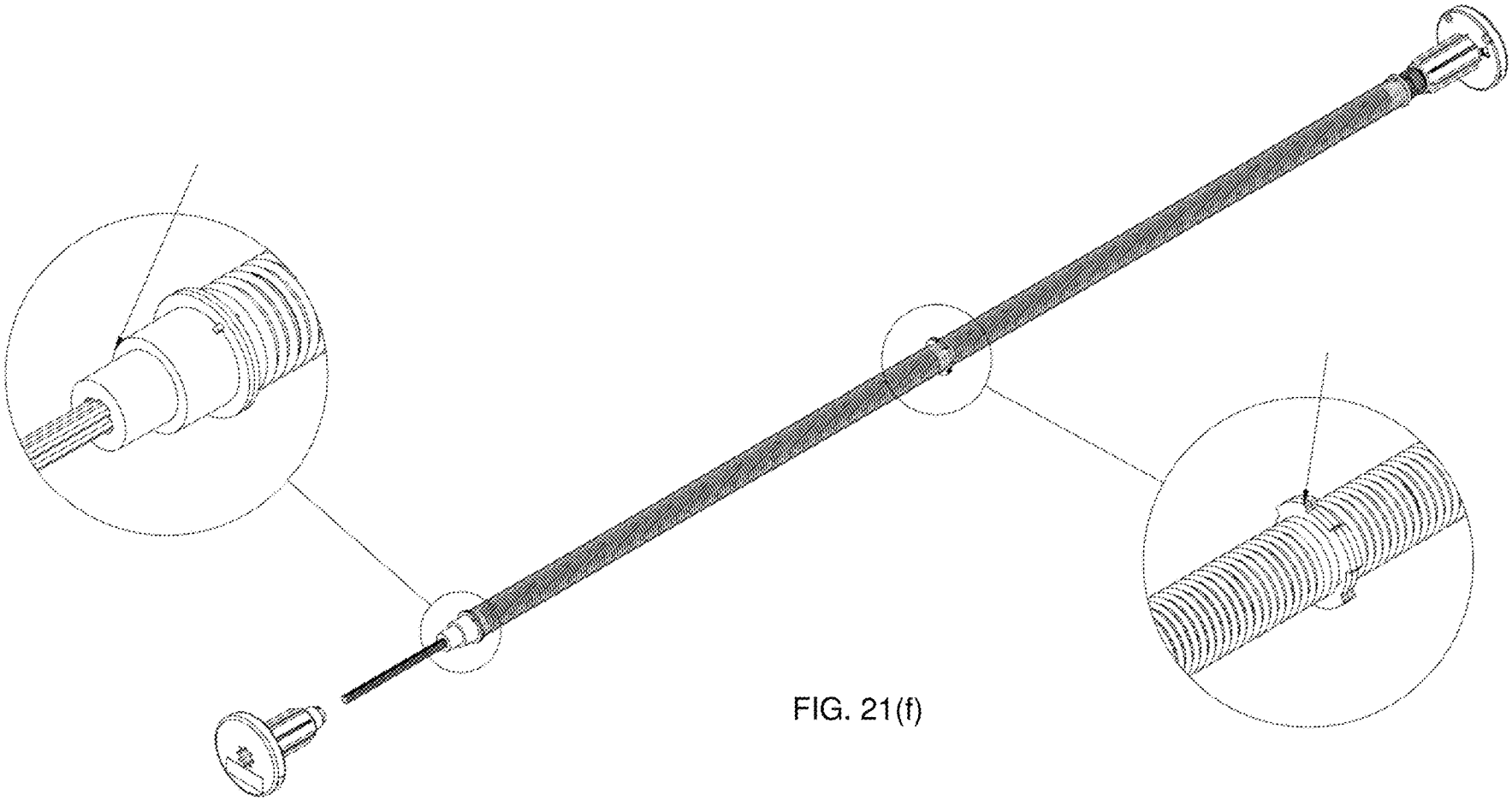

To provide further mounting arrangement flexibility, a lateral mounting bracket 810 can be coupled to the mounting bracket 126 as shown in FIG. 20(*a*). The lateral mounting bracket 810 includes a slot 812 through which a connector pin 814 extends. The connector pin 814 also extends through one of the slots 800 to enable the brackets 126, 810 to move with respect to each other in two dimensions. The coupled brackets 126, 810 therefore allow for a lateral mounting arrangement as shown in FIG. 20(*b*), in which the fasteners 802 are fed through a vertically oriented portion 816 of the lateral mounting bracket 810. In this way, a surface 822 that is generally normal to the length of the roller shade can be used as a mounting surface; for example, when a second surface 820 that is generally parallel thereto is unsuitable or desirable as a mounting surface.

FIGS. 21(*a*) to 21(*f*) show various configurations that can be used to provide the lift assist mechanism 210. In a base implementation, the lift assist mechanism 210 couples to the clutch assembly 103 as shown in FIG. 21(*a*). The lift assist mechanism 210 includes a fixed end 250 that mates with the clutch assembly 103 and a rotating end 254. The ends 250, 254 support a spring 252 therebetween. Since once end is fixed, as the rotatable end 254 rotates, the spring is either put into tension or released from tension to facilitate raising and lowering the shade 100. The rotatable end 254 includes a profiled flange 256 that interfaces with the grooves 242 to engage the tube 102 and rotate as the tube 102 rotates. The ends 250 and 254 are supported along a central shaft 258. The clutch and spring combination provides a smooth operation by relieving stress on the chain and sprocket and inhibiting chain failure. This also can provide a counter balance system to allow the shade 100 to be pulled down by the weighting bar 90 without damaging the primary clutch 103. In this way, the lift assist mechanism 210 can reduce the required pull force required for "finger tip" control, even on large shades 100.

Because of the modularity of the components described herein, the system 10 may be used for providing window coverings of various widths and lengths. Moreover, the fabric used for the shade can vary in weight. It has been found that a lift assist assembly comprising one or more lift assist mechanisms 210 can be provided to accommodate different weights through interchangeable components. For example, the spring 252 shown in FIG. 21(*a*) can provide a minimal torque for the spring to compensate against the weight of the fabric 100 and the weighting bar 90. A second setting can be provided, as shown in FIG. 21(*b*) by placing a first lift assist mechanism 210*a* at one end, and a second lift assist mechanism 210*b* at the other end, e.g., by mating each with one of the respective clutch assemblies 103, 200. Another spring 272 can also be used which has a second tension that is larger than the first tension, as shown in FIG. 21(*c*). This enables a third setting, if the second tension is more than twice the first.

As shown in FIG. 21(*d*), a first lift assist mechanism 210 using spring 252 can be used with a second lift assist mechanism 270 having spring 272 to provide a fourth setting. The fourth setting can also be provided by nesting the springs 252, 272 to provide a combined spring 282 that operates a single lift assist mechanism 280 as shown in FIG. 21(*e*). This configuration may be chosen when there are constraints due to the length of the tube 102.

It can be appreciated that the configurations shown in FIGS. 21(*a*) to 21(*e*) are non-exhaustive. For example, a lift assist mechanism 280 having a combined spring 282 can be coupled with a lift assist mechanism 210 having spring 252 and so forth. Other springs having different tensions can also be used to provide a series of interchangeable settings.

Additionally, as shown in FIG. 21(*f*), a pair of springs 252 can be connected in seriatim to increase the tension without having to support one of the lift assist mechanisms 210 at the other end of the tube 102. This may be required in configurations where a limit setting mechanism is used at the end opposite the primary clutch assembly 103.

Figure 22:
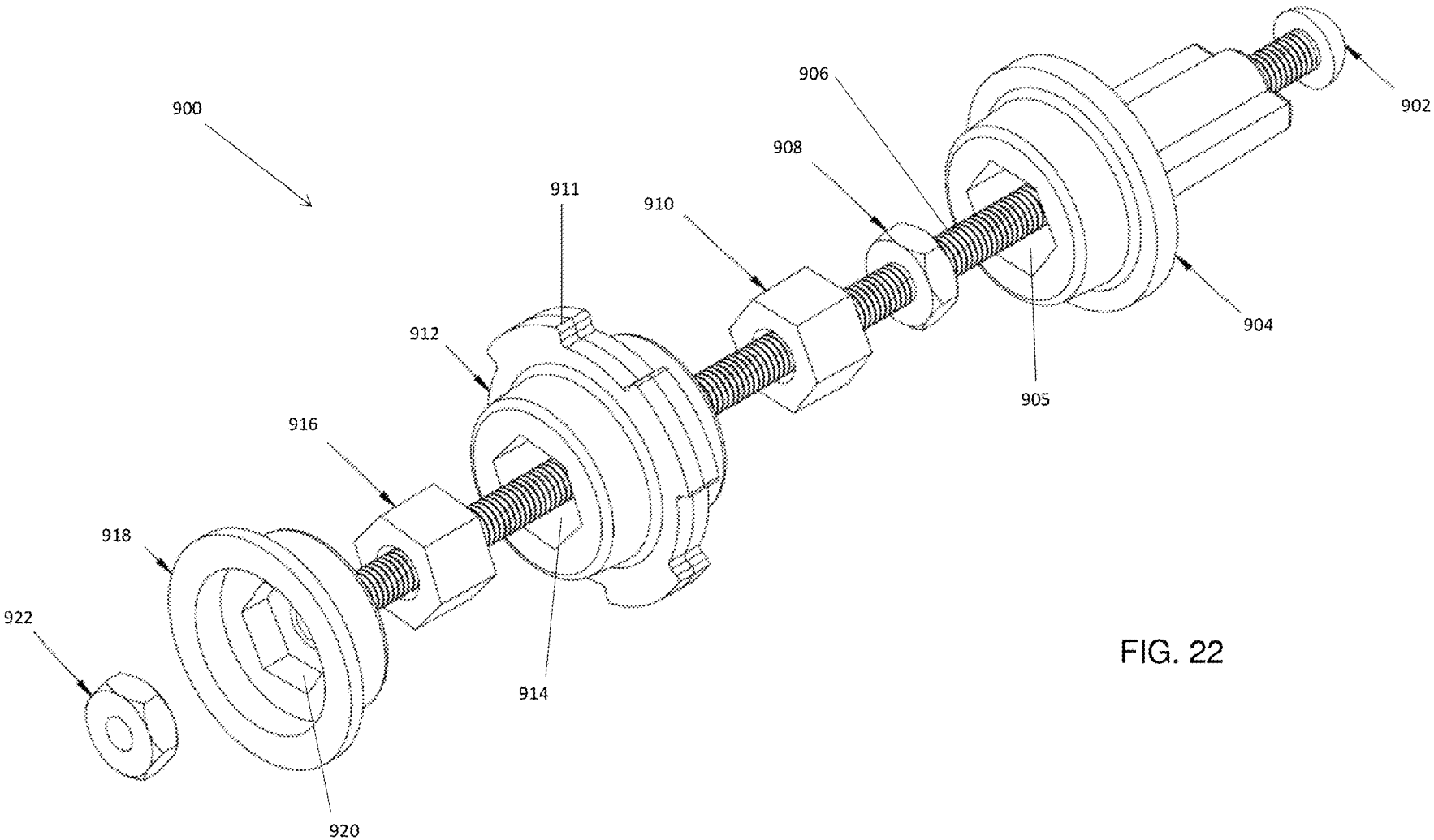
FIG. 22 is a perspective view of an internal limit setter.

Turning now to FIG. 22, an internal limit setter 900 is shown, which can be situated at one end of the tube 102 to provide upper and lower limits on the lowering and lifting of the fabric 100. The type of limit (i.e. upper/lower) is defined by the positions of the mechanism (left/right) and the type of rolling (normal reverse). An adapter plug 904 is configured similar to the end connector 234 shown in FIG. 6 to enable the internal limit setting 900 to be inserted into the idle end 106 or secondary clutch 200. The internal limit setter 900 also includes a traveling collar 912 that rotates along a threaded bolt 902 as the tube 102 rotates, by interfacing with the interior of the tube 102 by a profiled flange 911, similar to the lift assist mechanism 210. In this example configuration, an end connector 918 is threaded onto the bolt 902 and secured in place using a nut 922. A sleeve 910 is inserted in the plug 904 to cover a nut 908 that secures the adaptor plug 904 on the bolt 902. Another sleeve 916 is inserted into the collar 912 to inhibit rocking of the collar 912 on the bolt 902. When assembled, the collar 912 rotatably travels along the bolt 902 between the adapter plug 904 and the end connector 918. Since the collar 912 is engaged with the tube 102, it will limit further rotation of the tube 102 when hitting the plug 904 or connector 918 to provide upper and lower limits.

As noted above, the system 10 can be adapted to be used in various configurations, including with blackout roller shades with side channels. Such side channels typically include an inner channel having a pair of brushes that interface with the shade 100 to inhibit and substantially eliminate light leakage into the room being shaded. The modular assemblies shown herein can equally be adapted to accommodate blackout channels, including the adjustability of the chain guides 202.

The roller shade assemblies herein described can also be adapted to provide an automated roller shade 10 by accommodating an electric motor within the tube 102.

The roller shade system 10 can be assembled by joining a strip of the fabric 100 to the tube 102. The fabric 100 can be joined to the tube 102 using any suitable fastening mechanism, such as tape, adhesive, or a locking spline; and typically has a bottom weighting 90 at the opposite end. It can be appreciated that other mechanical fasteners such as pins, nails, or straps could also be used. It will be appreciated that other methods of joining the fabric 100 to the tube 102 known in the art can also be used. Once the fabric 100 is joined to the tube 102, the assembled clutch assemblies 103, 200 can be attached to the respective ends of the tube 102. If one or more lift assist mechanisms 210, 270, 280 and/or an internal limit setter 900 is being used, they would be inserted into the tube 102 with or prior to securing the clutch assemblies 103, 200 to the tube ends. It can be appreciated that tube adaptors 127, 128 and adapter discs 206, 208 would also be incorporated at the same time. For example, the tube 102 may have a diameter of 2 inches while the clutch assemblies 103, 200 normally fit within a diameter of 1.5 inches. As such, the adapter 127, 128 can be used to allow the tube 102 to mate with the clutch assemblies 103, 200.

The chain 104 can be coupled to the clutch assembly 103 to complete assembly of the lifting/lowering mechanism 101. The chain 104 is coupled to the clutch assembly 103 by mating the chain 104 into the teeth of the sprocket 300 and can be coupled either before or after the clutch assembly 103 is coupled to the tube 102. With two clutch assemblies 103, 200, the chain 104 can be coupled to either assembly 103, 200, or two chains 104 can be used. This allows further flexibility when assembling on site where preferences can change in the field.

The leveling mechanism 108 can be attached to each of the clutch assemblies 103, 200 or idle end 106 either prior to or after the assembly of the valance assembly 114. In both cases, the mantle 410 of the corresponding level adjuster 108 is inserted into a central aperture of the clutch assembly 103 or the idle end 106. The mantle 410 can now support the roll 100 and tube 102.

The modular valance assembly 114 can then be assembled around the level mechanism 108 to cover and conceal the lifting/lowering mechanism 101 to provide the desired cassette. The modular valance assembly 114 is secured to the leveling mechanism 108 through the use of socket screws 112 which are secured into the sockets 518 through the holes 414 on the plate 400. As discussed previously, the sockets 518 on the front fascia 116, rear fascia, bottom fascia 118, and assembly bracket 122 or top fascia 124 are aligned with the holes 414 on the plate 400. The modular valance assembly 114 can be assembled by joining the front fascia 116, rear fascia 117, bottom fascia 118, and top fascia 124 as discussed previously. It will also be seen that the modular valance assembly 114 can be joined in the desired configuration to suit either a regular roll or reverse roll roller system. The socket screws 112 can then be secured into the sockets 518 through the holes 414 securing the members of the valance assembly 114 in place, as well as the chain guard(s) 202.

After attaching the valance assembly 114, an end bracket cover 110 is secured to the outer surface of each leveling mechanism 108.

In order to affix the roller shade system 10 over a light permitting structure such as a window, mounting brackets 126 are first attached to a surface such as the inner frame of a window or directly to the ceiling. The mounting brackets 126 can be secured to the mounting surface by fastening the screws 130 to the mounting surface through the slits 128.

The roller shade system 10 can be attached to the mounting brackets 126 as discussed previously, by inserting the projecting rib 516 into a notch in the mounting brackets 126 and clasping the outer face of the assembly bracket 122 into the mounting bracket.

In order to operate the roller shade system 10 the chain 104 (or equivalent rolling mechanism) is pulled in a particular direction. The chain 104 in turn causes the clutch 103 to rotate which imparts rotation onto the tube 102. Rotation of the tube 102 causes winding or unwinding of the fabric 100 based on the direction of rotation and therefore raises or lowers the fabric 100. It will be appreciated that though the rotation of clutch 103 can be controlled by pulling the chain 104. Alternatively, a second clutch 200 with a chain 104 can be placed in place of the idle end 106 allowing the fabric 100 to be raised or lowered from either or both ends.

In order to adjust the level of the tube 102 after installation of the valance assembly 114, the location and configuration of the level adjuster 108 and adjusting screw 408 allows access to the adjusting screw 408 of the level adjuster 108 even with the bottom fascia 118 attached. This allows a convenient leveling of the tube 102 without having to disassemble the system. The adjusting screw 408 on each level adjuster 108 can then be adjusted to level the tube 102.

It will be seen that the roller shade system 10 presents a number of advantages. The compactness and low profile of the leveling mechanism 108 allows a simple way to level the roller shade system 10. When a roller shade system is properly leveled the fabric 100 will be properly aligned with the window 20 and thereby more efficiently and aesthetically cover the window 20. It will also be seen that due to the compactness of the leveling mechanisms 108, the width of the fabric 100 can be greater, further limiting the possibility of light leaking through the roller shade system 10.

It will be appreciated that the roller shade systems 10 also allows for flexibility and can be used with either a regular roll or reverse roll system while still employing the same valance assembly. As previously discussed, the modular valance assembly 114 can be configured to suit either a regular roll system or reverse roll system by adjusting the position of the bottom fascia 118. Similarly, the chain guides 202 can be extended to suit different sizes of cassettes and the central channel 706 permits rearrangement of the chain segments to accommodate obstructions such as blackout side channels. This allows for a quick and cost effective system that can meet the specific requirements of the user within the same system.

It will be appreciated that a variety of materials can be used. In the exemplary embodiment components of the lifting/lowering mechanism 101 are made of metals or plastics but it will be appreciated that metal or other suitable materials can also be used. Additionally, in the exemplary embodiment components of the modular valance assembly 114 are composed of metal such as aluminum but can also be composed of plastics.

For simplicity and clarity of illustration, where considered appropriate, reference numerals may be repeated among the figures to indicate corresponding or analogous elements. In addition, numerous specific details are set forth in order to provide a thorough understanding of the examples described herein. However, it will be understood by those of ordinary skill in the art that the examples described herein may be practiced without these specific details. In other instances, well-known methods, procedures and components have not been described in detail so as not to obscure the examples described herein. Also, the description is not to be considered as limiting the scope of the examples described herein.

It will be appreciated that the examples and corresponding diagrams used herein are for illustrative purposes only. Different configurations and terminology can be used without departing from the principles expressed herein. For instance, components and modules can be added, deleted, modified, or arranged with differing connections without departing from these principles.

Although the above principles have been described with reference to certain specific examples, various modifications thereof will be apparent to those skilled in the art as outlined in the appended claims.

The invention claimed is:

1. A roller shade system comprising:

an elongated covering material having low permeability to light;

a lifting and lowering mechanism having:

a hollow circular tube windingly coupled to the covering material, either a clutch assembly coupled to each end of the tube or a clutch assembly coupled to one end of the tube and an idle end coupled to the opposing end of the tube, and a chain coupled to each clutch wherein pulling the chain in one direction causes the tube to rotate in one direction and causes the covering material to roll onto the tube, while pulling the chain in the opposing direction causes the tube to rotate in the opposing direction causing the covering material to unroll from the tube;

a leveling mechanism having:

a baseplate, the baseplate having a flange, the flange having a passage;

a bar having a pivot coupled to the baseplate at one end, the pivot being spaced from the flange of the baseplate, the bar having a protrusion at an end aligned with the flange of the baseplate, the protrusion being positioned above the flange of the baseplate, and the bar having a support for the lifting and lowering mechanism located between the pivot and the protrusion; and an adjustment member interacting with the passage on the flange of the baseplate to enable advancement upwardly towards the protrusion and retraction downwardly away from the protrusion to adjust the rotational position of the bar and in turn the support by contacting and setting a position of the protrusion relative to the flange;

a modular valance assembly having:

a top valance member comprising at least one of: a top fascia and at least one top assembly bracket;

a front valance member connectable to the top valance member;

a rear valance member connectable to the top valance member; and a bottom valance member, wherein the bottom valance member is connectable to either the front valance member or the rear valance member to permit the covering material to extend from the tube in a regular roll or reverse roll configuration; and at least one mounting bracket attached to the either one of the modular valance assembly or leveling mechanism to secure the roller shade system to a surrounding surface.

2. The roller shade system of claim 1 wherein advancing the adjustment member through the passage causes the adjustment member to first contact the protrusion, and then cause the bar to rotate about the pivot coupling thereby raising the support of the roller shade system in height.

3. The roller shade system of claim 2 wherein retracting the adjustment member through the passage causes the adjustment member to reduce the force on the protrusion causing the bar to rotate in the opposing direction about the pivot coupling thereby lowering the support of the roller shade system in height.

4. The roller shade system of claim 3 wherein the passage is a threaded aperture.

5. The roller shade system of claim 4 wherein the adjustment member is a threaded screw.

6. The roller shade system of claim 5 wherein the support is a mantle for supporting one end of the roller shade system.

7. The roller shade system of claim 6 wherein a cover is attached to the outer face of the leveling mechanism.

8. The roller shade system of claim 7 wherein the at least one mounting bracket is attachable to the outer face of each cover to secure the roller shade to a surrounding surface.

9. The roller shade system of claim 1 wherein the valance members are made from a ductile metal.

10. The roller shade system of claim 9 wherein the rear valance member has a plurality of sockets to permit securing the rear valance member onto a surface using fasteners through the surface and into the sockets.

11. The roller shade system of claim 10 wherein the front, bottom, and top valance members have a plurality of sockets to permit securing any one of the valance members onto the surface using fasteners through the sockets.

12. The roller shade system of claim 1 wherein a spline is coupled to the bottom valance member.

13. The roller shade system of claim 1, further comprising a chain guide, the chain guide comprising a first member having at least one attachment point configured to mate with the valance assembly for the roller shade system at one end of the covering material, the chain guide further comprising a pair of passages to permit the chain used to operate the roller shade system to pass therethrough.

14. The roller shade system of claim 13, further comprising an additional passage located between the pair of passages to permit the chain to be repositioned with runs of the chain being closer to each other.

15. The roller shade system of claim 13, further comprising an extension piece, the extension piece being securable to at least one end of the first member to span valance assemblies of different sizes.

16. The roller shade system of claim 1, comprising:

a first clutch assembly secured to the one end of the tube; and a second clutch assembly secured to the opposing end of the tube;

wherein the first and second clutch assemblies have at least one surface adjacent respective edges of the material to maintain alignment of the material on the tube and inhibit fraying thereof;

wherein both the first clutch assembly and the second clutch assembly are capable of supporting respective chains to operate the system.

17. The roller shade system of claim 16, wherein the lifting and lowering mechanism is contained in the tube and is coupled to at least one of the clutch assemblies.

* * * * *